US009238889B2

(12) United States Patent
Paavola et al.

(10) Patent No.: US 9,238,889 B2
(45) Date of Patent: Jan. 19, 2016

(54) APPARATUS AND METHOD FOR CLOSED-LOOP CONTROL OF CREPED TISSUE PAPER STRUCTURE

(71) Applicant: Honeywell International Inc., Morristown, NJ (US)

(72) Inventors: Antti Paavola, Tampere (FI); Markku Kellomaki, Pohjois-Savo (FI)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 14/225,703

(22) Filed: Mar. 26, 2014

(65) Prior Publication Data

US 2015/0107791 A1 Apr. 23, 2015

Related U.S. Application Data

(60) Provisional application No. 61/892,252, filed on Oct. 17, 2013.

(51) Int. Cl.

| | |
|---|---|
| ***D21F 7/06*** | (2006.01) |
| ***D21F 11/14*** | (2006.01) |
| ***D21G 9/00*** | (2006.01) |

(52) U.S. Cl.

CPC *D21F 7/06* (2013.01); *D21F 11/14* (2013.01); *D21G 9/0036* (2013.01); *D21G 9/0045* (2013.01)

(58) Field of Classification Search

USPC ..... 700/128, 127, 129, 2, 6, 30, 103; 250/559.01, 559.04; 162/198, 263, 162/252, 112, 113

See application file for complete search history.

(56) References Cited

U.S. PATENT DOCUMENTS

| | | | | |
|---|---|---|---|---|
| 4,878,114 | A | 10/1989 | Huynh et al. | |
| 5,374,334 | A * | 12/1994 | Sommese et al. | 162/111 |
| 5,513,275 | A | 4/1996 | Khalaj et al. | |
| 5,654,799 | A | 8/1997 | Chase et al. | |
| 5,865,950 | A * | 2/1999 | Vinson et al. | 162/112 |

(Continued)

FOREIGN PATENT DOCUMENTS

| | | | |
|---|---|---|---|
| CA | 2 844 414 | A1 | 5/2013 |
| WO | WO 93/06300 | A1 | 4/1993 |

(Continued)

OTHER PUBLICATIONS

Markku Kellomaki, "Apparatus and Method for Characterizing Texture", U.S. Appl. No. 14/173,284, filed Feb. 5, 2014.

(Continued)

*Primary Examiner* — Kidest Bahta

(57) ABSTRACT

A method includes obtaining measurements associated with one or more controlled variables related to a structure of creped tissue paper during production of the creped tissue paper. The method also includes generating at least one control signal that adjusts one or more manipulated variables associated with the production of the creped tissue paper in order to alter the structure of the creped tissue paper. The one or more controlled variables include a number of folds per unit length of the creped tissue paper, a caliper of the creped tissue paper, a macro crepe of the creped tissue paper, and/or a micro crepe of the creped tissue paper. The manipulated variable(s) could include a crepe percentage, a creping blade angle, a flow of sizing agent, and/or a cross direction (CD) profile of nozzle positions associated with a spray boom that sprays sizing agent onto a Yankee dryer.

21 Claims, 18 Drawing Sheets

(56) References Cited

U.S. PATENT DOCUMENTS

| | | | | |
|---|---|---|---|---|
| 6,207,734 | B1 * | 3/2001 | Vinson | B31F 1/12 162/111 |
| 6,425,983 | B1 * | 7/2002 | Marinack et al. | 162/281 |
| 7,545,971 | B2 | 6/2009 | Shakespeare | |
| 8,840,775 | B2 * | 9/2014 | Chen et al. | 205/786.5 |
| 2002/0034338 | A1 | 3/2002 | Askary | |
| 2004/0264795 | A1 | 12/2004 | Fielding | |
| 2005/0217814 | A1 * | 10/2005 | Super | B31F 1/126 162/111 |
| 2007/0133878 | A1 | 6/2007 | Porikli et al. | |
| 2008/0013818 | A1 * | 1/2008 | Shakespeare | 382/141 |
| 2008/0019611 | A1 | 1/2008 | Larkin et al. | |
| 2008/0205518 | A1 | 8/2008 | Wilinski et al. | |
| 2011/0007940 | A1 | 1/2011 | Hamza et al. | |
| 2011/0284178 | A1 * | 11/2011 | Shakespeare | 162/198 |
| 2013/0116812 | A1 * | 5/2013 | Drasek et al. | 700/103 |

FOREIGN PATENT DOCUMENTS

| | | | |
|---|---|---|---|
| WO | WO 95/16072 | A1 | 6/1995 |
| WO | WO 2013/029546 | A1 | 3/2013 |
| WO | WO 2014/087046 | A1 | 6/2014 |

OTHER PUBLICATIONS

Markku Kellomaki, et al., "Apparatus and Method for Measuring Caliper of Creped Tissue Paper", U.S. Appl. No. 14/222,251, filed Mar. 21, 2014.

Jukka-Pekka Raunio et al., "Simulation of creping pattern in tissue paper", Nordic Pulp and Paper Research Journal, vol. 27, No. 2, 2012, p. 375-381.

J. J. Pawlak, et al., "Image Analysis Technique for the Characterization of Tissue Softness", p. 231-238. (No date).

Jukka-Pekka Raunio, et al., "Variability of Crepe Frequency in Tissue Paper; Relationship to Basis Weight", Control Systems 2012, p. 23-41.

Petr Jordan, "Image-Based Mechanical Characterization of Soft Tissue using Three Dimensional Ultrasound", Aug. 2008, 137 pages.

Soon-Il an, "Conditional Maximum Covariance Analysis and Its Application to the Tropical Indian Ocean SST and Surface Wind Stress Anomalies", Journal of Climate, vol. 16, Jun. 27, 2002 and Mar. 12, 2003, p. 2932-2938.

"Section 6: Principal Component and Maximum Covariance Analyses, Maximum Covariance Analysis (MCA)", Analysis of Climate and Weather Data, 2014, p. 69-103.

Christoph H. Lampert, et al., "Weakly-Paired Maximum Covariance Analysis for Multimodal Dimensionality Reduction and Transfer Learning", ECCV 2010, Part II, LNCS 6312, 2010, p. 566-579.

John Krumm, et al., "Local Spatial Frequency Analysis of Image Texture", 3rd International Conference on Computer Vision, Dec. 4-7, 1990, p. 354-358.

Qi Tian, et al., "Algorithms for Subpixel Registration", Computer Vision, Graphics, and Image Processing, vol. 35, No. 2, Aug. 1, 1986, p. 220-233.

European Search Report dated Mar. 6, 2015 in connection with European Patent Application No. EP 14 18 5565.

European Search Report dated Apr. 2, 2015 in connection with European Patent Application No. EP 14 18 5656.

Sylvia Drabycz, et al., "Image Texture Characterization Using the Discrete Orthonormal S-Transform", Journal of Digital Imaging, vol. 22, No. 6, Dec. 2009, p. 696-708.

* cited by examiner

900

902

APPARATUS AND METHOD FOR CLOSED-LOOP CONTROL OF CREPED TISSUE PAPER STRUCTURE

CROSS-REFERENCE TO RELATED APPLICATION AND PRIORITY CLAIM

This application claims priority under 35 U.S.C. 119(e) to U.S. Provisional Patent Application No. 61/892,252 filed on Oct. 17, 2013. This provisional patent application is hereby incorporated by reference in its entirety into this disclosure.

TECHNICAL FIELD

This disclosure relates generally to control systems. More specifically, this disclosure relates to an apparatus and method for closed-loop control of creped tissue paper structure.

BACKGROUND

Various manufacturers operate systems that produce crepe paper. Crepe paper is tissue paper that has been "creped" or crinkled. Crepe paper can have various properties that are important to downstream processes and end users, such as caliper (thickness) and softness.

Conventional crepe paper manufacturing systems often lack sensors for capturing on-line measurements of a crepe paper's structure. Rather, laboratory measurements of the crepe paper's structure are typically identified after the crepe paper has been manufactured. By identifying the crepe paper's structure after the crepe paper is manufactured, adjustments based on the measurements cannot be made in an on-line or real-time manner during production of the crepe paper.

SUMMARY

In a first embodiment, a method includes obtaining measurements associated with one or more controlled variables related to a structure of creped tissue paper during production of the creped tissue paper. The method also includes generating at least one control signal that adjusts one or more manipulated variables associated with the production of the creped tissue paper in order to alter the structure of the creped tissue paper. The one or more controlled variables include a number of folds per unit length of the creped tissue paper, a caliper of the creped tissue paper, a macro crepe of the creped tissue paper, and/or a micro crepe of the creped tissue paper.

In a second embodiment, an apparatus includes at least one processing device that is configured to obtain measurements associated with one or more controlled variables related to a structure of creped tissue paper. The at least one processing device is also configured to determine how to adjust one or more manipulated variables associated with production of the creped tissue paper in order to alter the structure of the creped tissue paper. The at least one processing device is further configured to generate at least one control signal for adjusting the one or more manipulated variables. The one or more controlled variables include a number of folds per unit length of the creped tissue paper, a caliper of the creped tissue paper, a macro crepe of the creped tissue paper, and/or a micro crepe of the creped tissue paper.

In a third embodiment, a non-transitory computer readable medium embodies a computer program. The computer program includes computer readable program code for obtaining measurements associated with one or more controlled variables related to a structure of creped tissue paper. The computer program also includes computer readable program code for generating at least one control signal for adjusting one or more manipulated variables associated with production of the creped tissue paper in order to alter the structure of the creped tissue paper. The one or more controlled variables include a number of folds per unit length of the creped tissue paper, a caliper of the creped tissue paper, a macro crepe of the creped tissue paper, and/or a micro crepe of the creped tissue paper.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 26, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

"Crepe structure" is an important variable in creped tissue paper manufacturing. The crepe structure generally represents the characteristics of the tissue paper caused by the creping process, such as the number of "folds" per some unit of length. The crepe structure contributes to the creped tissue paper's caliper and softness, which are often principal quality parameters for high-end grades of creped tissue paper.

With the development of on-line sensors for measuring crepe structure (such as the scale of the creped tissue paper's texture), it becomes possible to use on-line measurements to control the crepe structure during a manufacturing process. More specifically, on-line measurements can be used to support closed-loop control of the crepe structure during the manufacturing process. As a result, the crepe structure can be modified during the manufacturing process so that the resulting creped tissue paper has more desirable characteristics.

Figure 1:
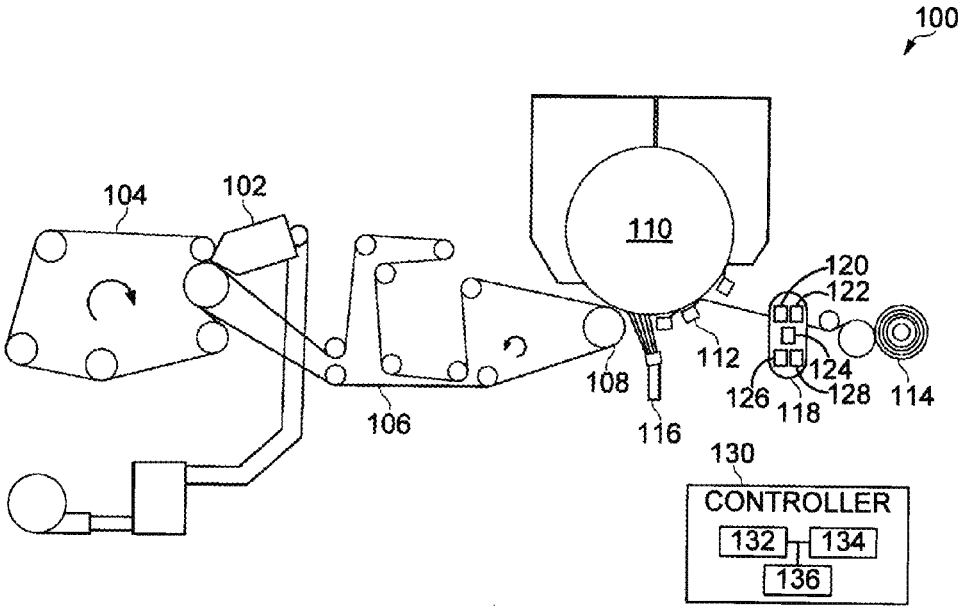
FIG. 1 illustrates an example system for closed-loop control of creped tissue paper structure according to this disclosure.

FIG. 1 illustrates an example system 100 for closed-loop control of creped tissue paper structure according to this disclosure. As shown in FIG. 1, an aqueous slurry of paper fibers is provided to a headbox 102. The headbox 102 deposits the slurry onto a substrate 104, such as a wire mesh. The substrate 104 allows water from the slurry to drain away and leave a wet web of paper fibers on the substrate 104. The substrate 104 is moved along its length in a continuous loop by multiple rollers.

The wet web of paper fibers is transferred to a press felt 106. The press felt 106 is also moved along its length in a continuous loop by multiple rollers. The press felt 106 carries the wet web of paper fibers to a pressure roll 108. The pressure roll 108 transfers the wet web of paper fibers to the surface of a Yankee dryer 110 (also called a creping cylinder). The Yankee dryer 110 dries the web of paper fibers as the Yankee dryer 110 rotates.

The dried web of paper fibers is removed from the surface of the Yankee dryer 110 by the application of a creping doctor 112. The creping doctor 112 includes a blade that forms crepe structures in the web of paper fibers. The resulting creped web of paper fibers is collected on a reel or drum 114 as creped tissue paper.

A spray boom 116 sprays material, such as a sizing agent, onto the Yankee dryer 110 before the wet web of paper fibers contacts the Yankee dryer 110. The sizing agent helps to hold the wet web of paper fibers against the Yankee dryer 110. The amount of creping produced by the creping doctor 112 depends in part on the amount of sizing agent applied to the Yankee dryer 110 by the spray boom 116. In some embodiments, the spray boom 116 includes multiple nozzles arranged across the width of the Yankee dryer 110, where each nozzle sprays the sizing agent onto a portion or zone of the Yankee dryer 110. The nozzles can have associated actuators that are controlled in order to control the amount of sizing agent sprayed onto the Yankee dryer 110.

As noted above, the tissue paper industry lacks on-line (non-laboratory) methods and devices for measuring and controlling various characteristics of its products. In accordance with this disclosure, a scanner 118 includes one or more sensors that measure at least one characteristic related to the crepe structure of creped tissue paper being manufactured. For example, the scanner 118 could include one or more sensors for measuring the number of folds per unit length in the creped tissue paper, the caliper of the creped tissue paper, the macro crepe of the creped tissue paper, and/or the micro crepe of the creped tissue paper. The macro crepe identifies the variance of reflected light (graylevel) related to the dominant fold size of the tissue paper, while the micro crepe identifies the variance of reflected light (graylevel) related to smaller fold sizes of the tissue paper. Any additional characteristic(s) of the creped tissue paper could also be measured. Each sensor in the scanner 118 could be stationary or move across part or all of the width of the creped tissue paper being manufactured. The scanner 118 can use the techniques described below to measure one or more characteristics of the creped tissue paper.

The scanner 118 includes any suitable structure(s) for measuring one or more characteristics related to the crepe structure of creped tissue paper. For example, the scanner 118 could include at least one illumination source 120 for illuminating the creped tissue paper, such as with collimated light at an oblique angle. The scanner 118 could also include a digital camera or other imaging device 122 that captures digital images of the creped tissue paper. The scanner 118 could further include at least one processing device 124 that analyzes images from the imaging device 122 to measure one or more characteristics of the creped tissue paper. In addition, the scanner 118 could include at least one memory 126 storing instructions and data used, generated, or collected by the scanner 118 and at least one interface 128 facilitating communication with other devices, such as a process controller.

Each illumination source 120 includes any suitable structure for generating illumination for creped tissue paper, such as one or more light emitting diodes (LEDs), pulsed laser diodes, laser diode arrays, or other light source(s). Each imaging device 122 includes any suitable structure for capturing digital images of creped tissue paper, such as a CMOS, CCD, or other digital camera. Each processing device 124 includes any suitable processing or computing device, such as a microprocessor, microcontroller, digital signal processor, field programmable gate array, application specific integrated circuit, or discrete logic devices. Each memory 126 includes any suitable storage and retrieval device, such as a random access memory (RAM) or Flash or other read-only memory (ROM). Each interface 128 includes any suitable structure facilitating communication over a connection or network, such as a wired interface (like an Ethernet interface) or a wireless interface (like a radio frequency transceiver).

In particular embodiments, the functionality for measuring one or more characteristics of creped tissue paper can be incorporated into a FOTOSURF surface topography sensor available from HONEYWELL INTERNATIONAL INC. For example, software or firmware instructions for performing the techniques described in this patent document could be loaded onto at least one memory device in the FOTOSURF sensor and executed. The modified FOTOSURF sensor could then be used with the appropriate orientation and possibly backing to measure one or more characteristics of creped tissue paper.

Measurements from the scanner 118 can be used in any suitable manner, such as to optimize or control the creped tissue paper manufacturing process. For example, the scanner 118 can provide measurements to at least one controller 130, which can adjust the manufacturing or other process(es) based on the measurements. As a particular example, the controller(s) 130 could adjust the operation of the headbox 102, Yankee dryer 110, creping doctor 112, reel 114, and/or spray boom 116 based on the measurements.

Each controller 130 includes any suitable structure for controlling at least part of a process. For example, each controller 130 could include at least one processing device 132, at least one memory 134, and at least one interface 136. The processing device(s) 132 can execute control logic for adjusting a manufacturing or other process. The memory or memories 134 can store the control logic or other control functionality and any related data. The interface(s) 136 can support communications with other devices, such as the scanner 118 and any actuators for adjusting the manufacturing process.

Each processing device 132 includes any suitable processing or computing device, such as a microprocessor, microcontroller, digital signal processor, field programmable gate array, application specific integrated circuit, or discrete logic devices. Each memory 134 includes any suitable storage and retrieval device, such as a RAM or ROM. Each interface 136 includes any suitable structure facilitating communication over a connection or network, such as a wired interface (like an Ethernet interface) or a wireless interface (like a radio frequency transceiver).

Although FIG. 1 illustrates one example of a system 100 for closed-loop control of creped tissue paper structure, various changes may be made to FIG. 1. For example, the functional division shown in FIG. 1 is for illustration only. Various components in FIG. 1 could be combined, further subdivided, or omitted and additional components could be added according to particular needs. Also, FIG. 1 illustrates a simplified example of one type of system that can be used to manufacture creped tissue paper. Various details are omitted in this simplified example since they are not necessary for an understanding of this disclosure.

Figure 2A:
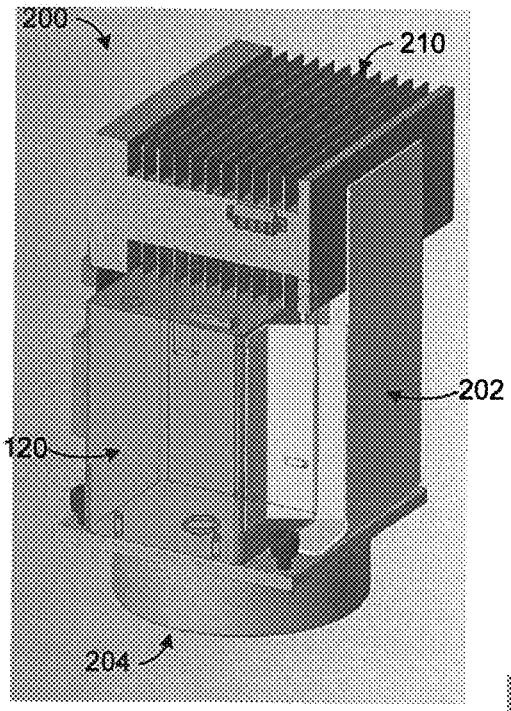
FIGS. 2A through 2C illustrate an example sensor for measuring one or more characteristics of creped tissue paper according to this disclosure.
Figure 2B:
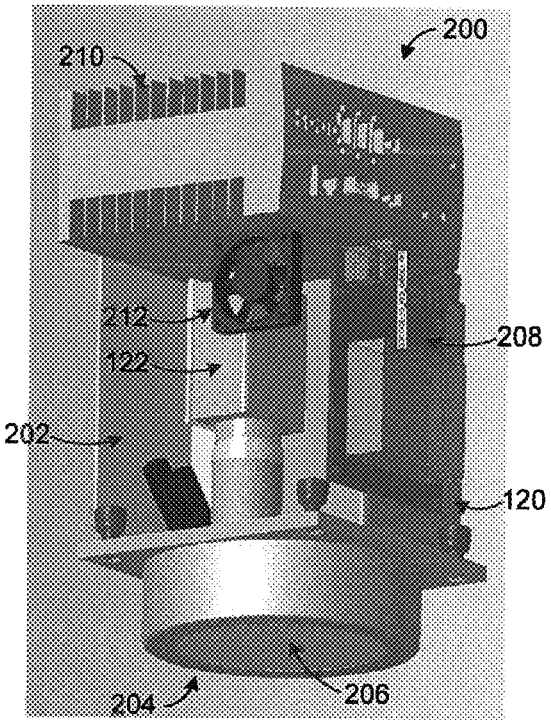
Figure 2C:
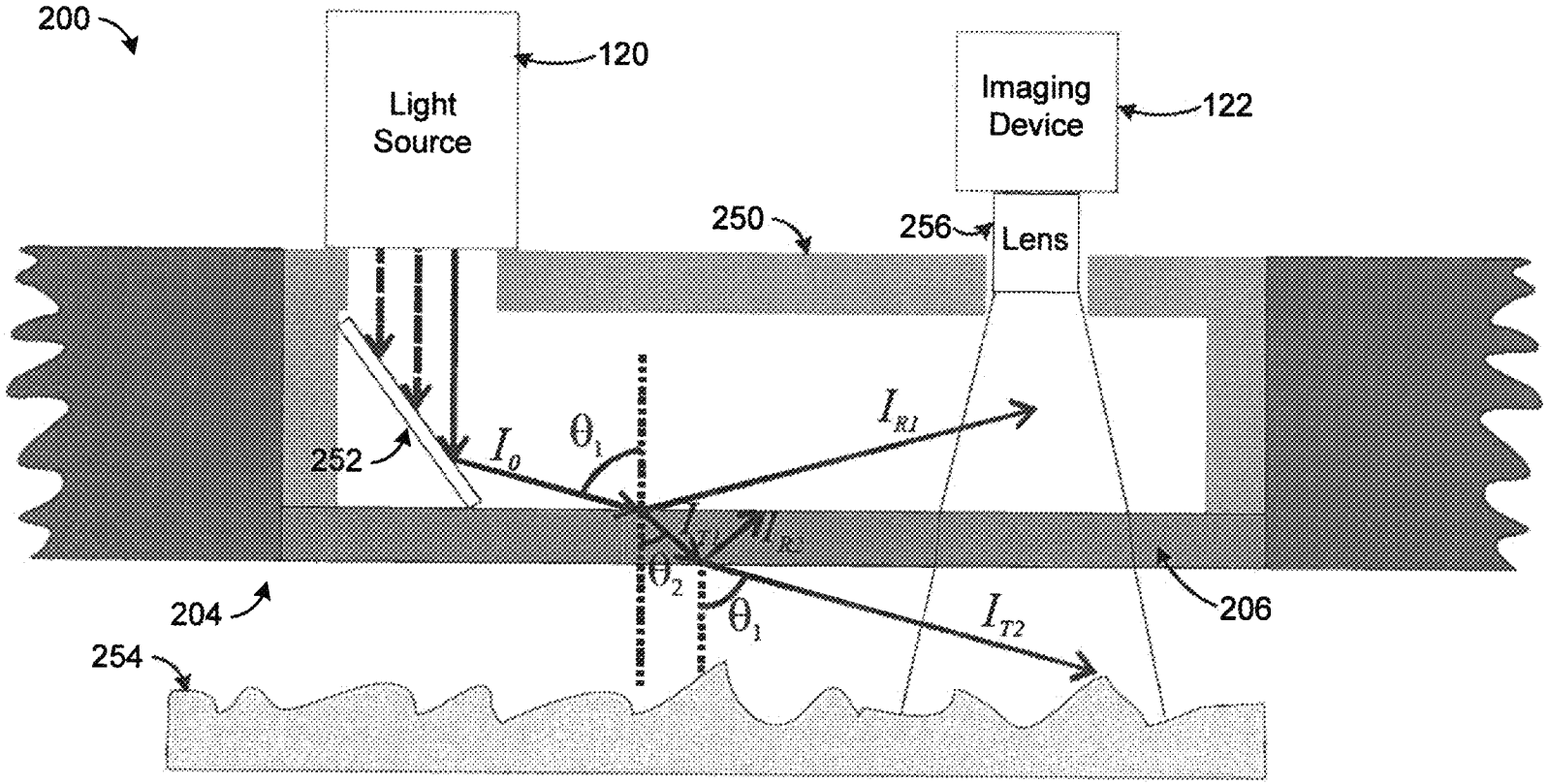

FIGS. 2A through 2C illustrate an example sensor 200 for measuring one or more characteristics of creped tissue paper according to this disclosure. The sensor 200 could, for example, be used in the scanner 118 of FIG. 1. Note that the scanner 118 in FIG. 1 could include a single sensor 200 or multiple instances of the sensor 200. Also note that the sensor 200 need not be used in a scanner and could be used in other ways, such as at a fixed position.

As shown in FIGS. 2A and 2B, the sensor 200 includes the illumination source 120 and the imaging device 122. A housing 202 encases, surrounds, or otherwise protects or supports these and other components of the sensor 200. The housing 202 could have any suitable size, shape, and dimensions. The housing 202 could also be formed from any suitable material (s), such as metal or ruggedized plastic, and in any suitable manner.

A window assembly 204 having a window 206 is positioned at one end of the housing 202. The window assembly 204 represents the portion of the sensor 200 that is directed toward a web of creped tissue paper for measurement of the tissue paper's caliper. The window 206 can help to protect other components of the sensor 200 from damage or fouling. The window 206 can also be optically transparent to illumination used to measure the caliper. For example, the creped tissue paper could be illuminated by the illumination source 120 through the window 206, and an image of the creped tissue paper can be captured by the imaging device 122 through the window 206. In some embodiments, the window 206 can be mounted flush within the window assembly 204 so that little or no dirt or other materials can accumulate on the window 206. The window assembly 204 includes any suitable structure for positioning near a web of material being measured. The window 206 could be formed from any suitable material(s), such as glass, and in any suitable manner.

A power and signal distribution board 208 facilitates the distribution of power and signaling between other components of the sensor 200. For example, the board 208 can help to distribute power to and signals between the illumination source 120, the imaging device 122, and a control unit 210 of the sensor 200. The board 208 includes any suitable structure for distributing power and signaling.

The control unit 210 represents the processing portion of the sensor 200. For example, the control unit 210 could include the processing device 124, memory 126, and interface 128 described above. Among other things, the control unit 210 could control the illumination of a creped tissue paper and analyze images of the tissue paper to identify the caliper of the tissue paper.

Thermal management is provided in the sensor 200 using, among other components, a fan 212. However, any other or additional component(s) could be used to provide thermal management in the sensor 200.

As shown in FIG. 2C, the sensor 200 includes the illumination source 120 and the imaging device 122 described above. The illumination source 120 generates illumination that is provided into an enclosure 250, where a mirror 252 redirects the illumination towards the window 206. For example, the illumination source 120 could emit a pulse of light that is reflected by the mirror 252. The mirror 252 includes any suitable structure for redirecting illumination.

The window 206 refracts part of the illumination towards a web 254 of creped tissue paper. The window 206 can therefore act as an optical element to translate a beam of illumination. The thickness of the window 206 can be selected to deflect the illumination to a desired position. The use of the mirror 252 in conjunction with the window 206 allows the sensor 200 to illuminate the web 254 at a low incidence angle in a relatively small space.

In some embodiments, the web 254 is illuminated at an oblique angle using collimated light. The oblique angle is more than 0° and less than 90° from the normal of the web's surface. In particular embodiments, the oblique angle (as measured normal to the web 254) can be between 60° and 85° inclusive.

At least some of the illumination is reflected from the web 254 and directed back through the window 206 to a lens 256. The lens 256 focuses the light onto the imaging device 122, allowing the imaging device 122 to capture a focused image of the creped tissue paper. The lens 256 includes any suitable structure for focusing light. In some embodiments, the imaging device 122 captures digital images of the web 254 at substantially 90° to the web 254, which could be done in order to maximize the contrast of the captured images.

In some embodiments, reflections from the window 206 and the enclosure 250 could be reduced or minimized using various techniques. For example, the illumination source 120 could emit p-polarized light, and a black matte finish could be used within the enclosure 250. P-polarized light could be generated in any suitable manner, such as by filtering unpolarized light or by using an inherently polarized light source (such as a laser) as the illumination source 120.

The control unit 210 analyzes capture images of the creped tissue paper in order to identify one or more characteristics of the creped tissue paper. For example, the control unit 210 could analyze one or more capture images to identify the number of folds per unit length of the web 254, the caliper of the web 254, the macro crepe of the web 254, and/or the micro crepe of the web 254. One example of the type of analysis that could be performed by the control unit 210 to identify one or more characteristics of the creped tissue paper is provided below.

In some embodiments, compensation for passline and tilt variations can be supported in the sensor 200. Passline variations occur when the web 254 moves away from a desired location with respect to the sensor 200. Tilt variations occur when the web 254 tilts in one or more directions with respect to a desired orientation of the web 254. The control unit 210 can compensate for these types of variations, such as by modifying digital images prior to analysis. The control unit 210 could also perform any other or additional optical, geometrical, or statistical corrections, such as to compensate for optical aberrations, vignetting, depth of focus, and temperature-dependent noise. Further, the control unit 210 could alter values calculated using the images (such as calipers or values used to identify the calipers) to correct the problems noted above.

Various techniques are known in the art for identifying the tilt and the distance of an imaging device from an object. In one example technique, a known pattern of illumination (such as three spots) can be projected onto the web 254, and the imaging device 122 can capture an image of the web 254 and the projected pattern. The pattern that is captured in the image varies based on the tilt of the web 254 or imaging device 122 and the distance of the web 254 from the imaging device 122. As a result, the captured image of the pattern can be used by the control unit 210 to identify the tilt angles of the web 254 in two directions with respect to the imaging device 122, as well as the distance of the web 254 from the imaging device 122. Note, however, that there are various other techniques for identifying tilt and distance of an object with respect to an imaging device, and this disclosure is not limited to any particular technique for identifying these values.

Although FIGS. 2A through 2C illustrate one example of a sensor 200 for measuring one or more characteristics of creped tissue paper, various changes may be made to FIGS. 2A through 2C. For example, the functional division shown in FIGS. 2A through 2C is for illustration only. Various components in FIGS. 2A through 2C could be combined, further subdivided, or omitted and additional components could be added according to particular needs. Also, the size, shapes, and dimensions of each component could be varied. In addition, note that the control unit 210 need not perform any analysis functions to identify one or more characteristics of creped tissue paper and could simply transmit images (with or without pre-processing) to an external device or system for analysis.

Figure 3A:
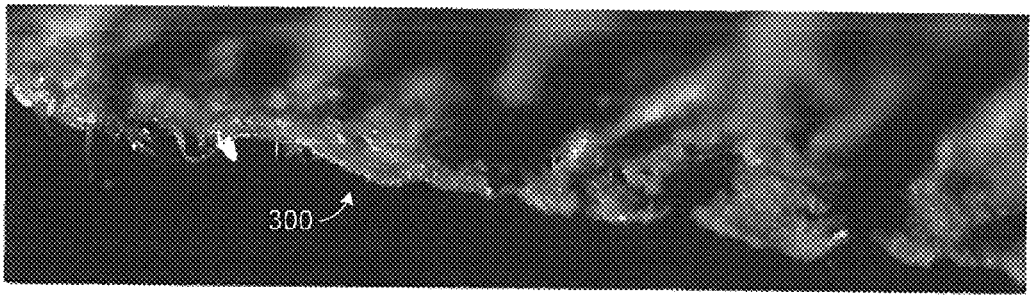
FIGS. 3A and 3B illustrate examples of creped tissue papers with different thicknesses according to this disclosure.
Figure 3B:
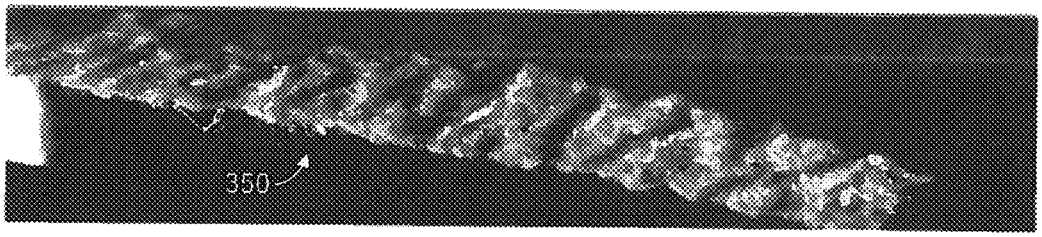

FIGS. 3A and 3B illustrate examples of creped tissue papers 300, 350 with different thicknesses according to this disclosure. As shown in FIG. 3A, the creped tissue paper 300 generally has a smaller number of crepe folds (undulations) in a given area, and the crepe folds that are present include a number of crepe folds having larger amplitudes. In contrast, as shown in FIG. 3B, the creped tissue paper 350 generally has a larger number of crepe folds in a given area, and the crepe folds that are present include more crepe folds having smaller amplitudes. The amplitudes refer to the distances from the tops of the crepe folds to the bottoms of the crepe folds.

It can be seen here that the total caliper of a creped tissue paper comes predominantly from the amplitudes of the crepe folds in the tissue paper. Larger crepe folds result in larger thicknesses, while smaller crepe folds result in smaller thicknesses. The thickness of any un-creped tissue paper is typically a much smaller component of the total caliper of the creped tissue paper.

Moreover, it can be seen here that the amplitudes of the crepe folds depend (at least in part) on the number of crepe folds in a given area. When there are more crepe folds in a given area of a creped tissue paper, the crepe folds tend to be smaller, and the creped tissue paper has a smaller caliper. When there are fewer crepe folds in a given area of a creped tissue paper, the crepe folds tend to be larger, and the creped tissue paper has a larger caliper.

Based on this understanding, the following presents one example of the type of analysis that could be performed by the control unit 210 to identify the caliper of the creped tissue paper. In some embodiments, the total caliper C of a creped tissue paper can be expressed as:

$$C=C_0+C_{CS} \tag{1}$$

where $C_0$ denotes the base caliper typical for a given grade of tissue paper, and $C_{CS}$ denotes a crepe structure-dependent component of the total caliper C.

The base caliper $C_0$ is a function of various parameters associated with the production of creped tissue paper. For example, the base caliper $C_0$ can be determined as a function of the crepe percentage being used, the basis weight of the tissue paper being creped, and one or more characteristics of the stock provided to the headbox 102 (such as the stock's fiber content). The crepe percentage is a grade-dependent parameter that, in some embodiments, can be expressed as:

$$((RS_{YD}-RS_{R/D})/RS_{YD})*100 \tag{2}$$

where $RS_{YD}$ denotes the rotational speed of the Yankee dryer 110, and $RS_{R/D}$ denotes the rotational speed of the reel or drum 114. Different base caliper values $C_0$ can be determined experimentally for various tissue grades and combinations of parameters, and the appropriate base caliper value $C_0$ can be selected during a particular run of tissue paper.

The crepe structure-dependent component $C_{CS}$ is a function of various parameters associated with the creped tissue paper. For example, the component $C_{CS}$ can be determined as a function of the dominant frequency of the creped tissue paper (denoted $\omega$) and the standard deviation of the intensity of diffusely-reflected light from the creped tissue paper (denoted $\sigma_r$). Both the $\omega$ and $\sigma_r$ values are based on the structure of the creped tissue paper, so the component $C_{CS}$ is dependent on visual changes in the creped tissue paper's structure.

The total caliper of a creped tissue paper could therefore be calculated by selecting the $C_0$ and $C_{CS}$ components for the tissue grade being manufactured and identifying the $\omega$ and $\sigma_r$ values. The control unit 210 can identify the $\omega$ and $\sigma_r$ values using one or more images captured by the imaging device 122, and the control unit 210 can use the $\omega$ and $\sigma_r$ values to calculate the caliper of the creped tissue paper.

Figure 4:
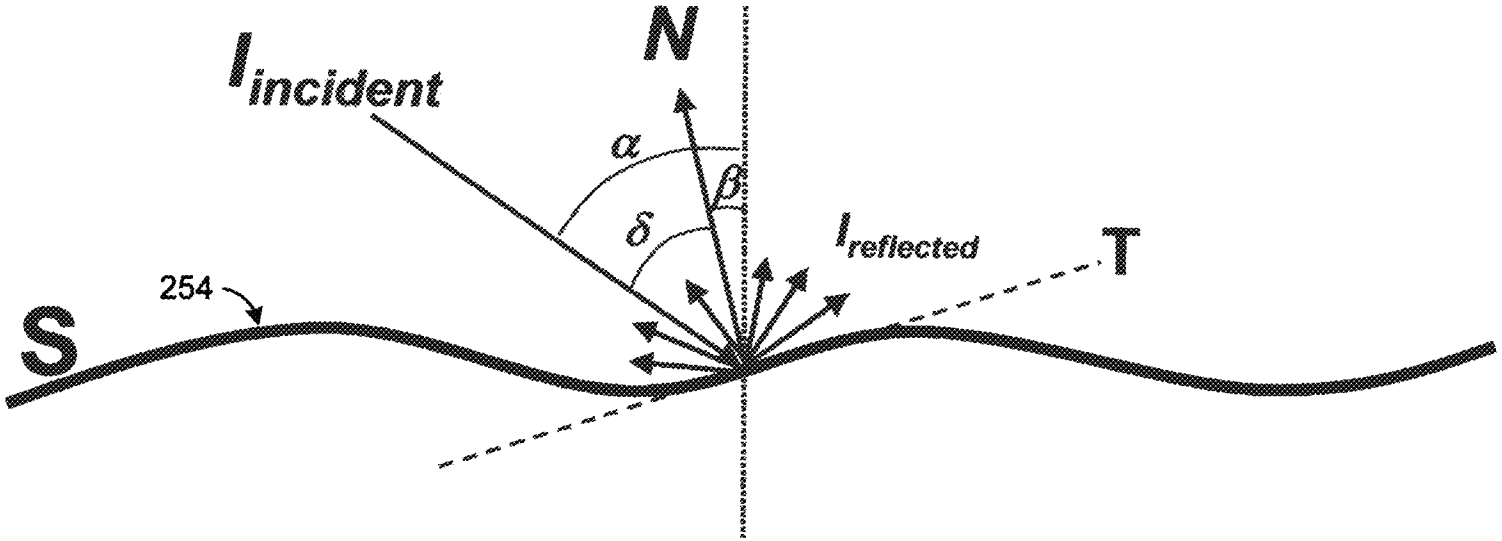
FIG. 4 illustrates an example illumination of creped tissue paper according to this disclosure.

When identifying the $\omega$ and $\sigma_r$ values, an assumption can be made that the web 254 is optically Lambertian, meaning the surface of the web 254 is diffusively reflective. FIG. 4 illustrates an example illumination of creped tissue paper according to this disclosure. More specifically, FIG. 4 illustrates an example illumination of the web 254 under the assumption that the web 254 is optically Lambertian. Here, the intensity of the reflected illumination is substantially isotropic, or independent of the reflection direction.

Based on this assumption, to determine the dominant frequency $\omega$ of a creped tissue paper, the control unit 210 can determine the dominant crepe fold size within a given area of the web 254. The control unit 210 can then count how many folds with such dominant fold size fit within some unit length (such as within a one-inch wide area of the web 254). The counted number of crepe folds per unit length represents the dominant frequency $\omega$.

Figure 5A:
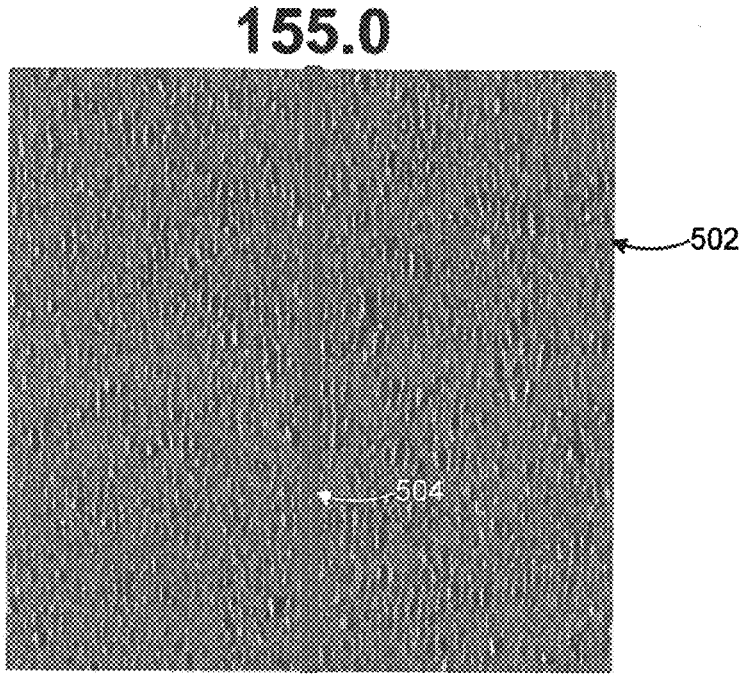
FIGS. 5A and 5B illustrate examples of counting crepe folds per unit length in different creped tissue papers according to this disclosure.
Figure 5B:
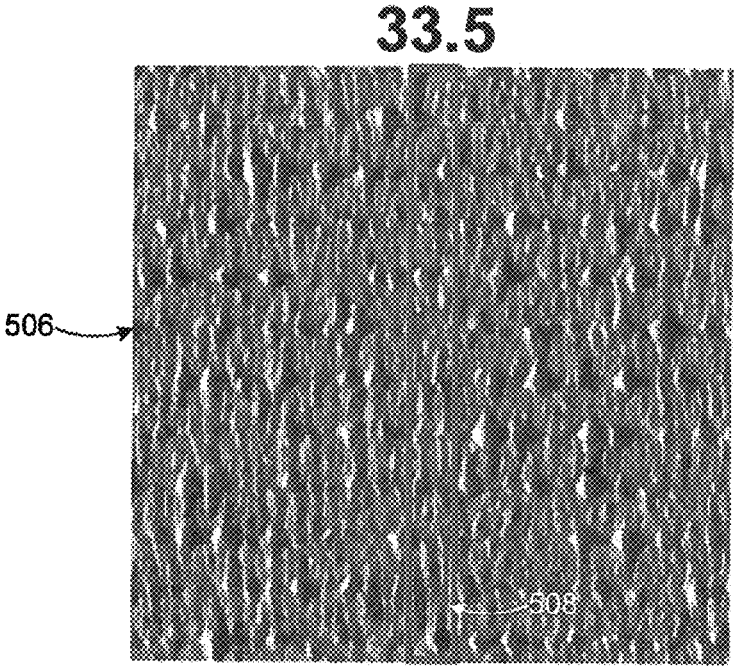

FIGS. 5A and 5B illustrate examples of counting crepe folds per unit length in different creped tissue papers according to this disclosure. In FIG. 5A, a creped tissue paper 502 is shown having very small crepe folds, and a line 504 identifies a unit length (such as one inch) across the creped tissue paper 502. Since the crepe folds are smaller, the number of crepe folds per unit length is quite high (155 folds per inch in this case). In FIG. 5B, a creped tissue paper 506 is shown having much larger crepe folds, and a line 508 identifies a unit length (such as one inch) across the creped tissue paper 506. Since the crepe folds are larger, the number of crepe folds per unit length is much lower (33.5 folds per inch in this case).

Here, the "dominant" crepe fold size could represent the most common fold size within a given area of a creped tissue paper. With a smaller dominant crepe fold size, the crepe folds are generally smaller and more numerous. With a larger dominant crepe fold size, the crepe folds are generally larger and less numerous. One example technique for determining the dominant crepe fold size within a given area of a web is described below with respect to FIGS. 8 through 9B. Additional details of this example approach can be found in U.S. patent application Ser. No. 14/173,284 filed on Feb. 5, 2014, which is hereby incorporated by reference in its entirety into this disclosure.

With respect to the standard deviation $\sigma_r$ of the intensity of diffusely-reflected light from a creped tissue paper, under the Lambertian assumption, light reflected from a perfectly sinusoidal surface is evenly diffused. Any variations in the sinusoidal surface would alter the diffusion of light. Thus, variations in the surface of the web 254 can be used to identify the standard deviation $\sigma_r$ of the intensity of diffusely-reflected light from the web 254.

To determine the expected standard deviation $\sigma_r$, the control unit 210 can determine the variance of reflected light (graylevel) related to the dominant fold size of the tissue paper. This can be expressed as the "macro crepe" of a creped tissue paper.

In some embodiments, the macro crepe can be calculated by integrating a one-sided power spectral density P(v) of a graylevel signal over a band between frequencies $v_1$ and $v_2$ that cover the dominant fold frequency ω. This can be expressed as follows:

$$\text{Macro Crepe} = \sigma_r^2(v_1 v_2) = \int_{v_1}^{v_2} P(v)\,dv \tag{3}$$

For $v_1$ and $v_2$, it holds that $\omega \epsilon [v_1, v_2]$. Frequencies $v_1$ and $v_2$ can be constants that satisfy this condition, or $v_1$ and $v_2$ could be dynamically dependent on the dominant fold frequency ω. The standard deviation $\sigma_r$ of diffusely-reflected light from the web can then be calculated as:

$$\sigma_r = \sqrt{\sigma_r^2(v_1, v_2)} = \sqrt{\text{MacroCrepe}} \tag{4}$$

For computational efficiency, the power spectral density P(v) can be extracted as a side product from an FFT-based auto-covariance computation (described below with respect to FIG. 8). An average of power spectral density of lines can be computed to obtain the average power spectral density of an image efficiently. This method can be applied for any discrete data with any dimension or direction.

In some embodiments, the micro crepe can be calculated by integrating a one-sided power spectral density P(v) of a graylevel signal over a band between frequencies $v_3$ and $v_4$ that are higher than the dominant fold frequency ω. This can be expressed as follows:

$$\text{Micro Crepe} = \sigma_{micro}^2(v_3, v_4) = \int_{v_3}^{v_4} P(v)\,dv \tag{5}$$

For $v_3$ and $v_4$, it holds that $\omega < v_3$ and $v_3 < v_4$. Frequencies $v_3$ and $v_4$ can be constants that satisfy this condition, or $v_3$ and $v_4$ could be dynamically dependent on the dominant fold frequency ω. For computational efficiency, the power spectral density P(v) can be extracted as a side product from an FFT-based auto-covariance computation (described below with respect to FIG. 8). An average of power spectral density of lines can be computed to obtain the average power spectral density of an image efficiently. This method can be applied for any discrete data with any dimension or direction.

Figure 6A:
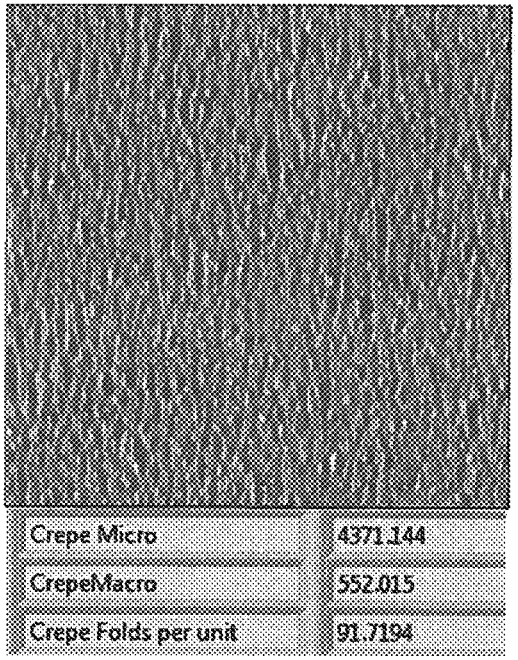
FIGS. 6A through 6C illustrate examples of measuring macro crepe and micro crepe variations for different creped tissue papers according to this disclosure.
Figure 6B:
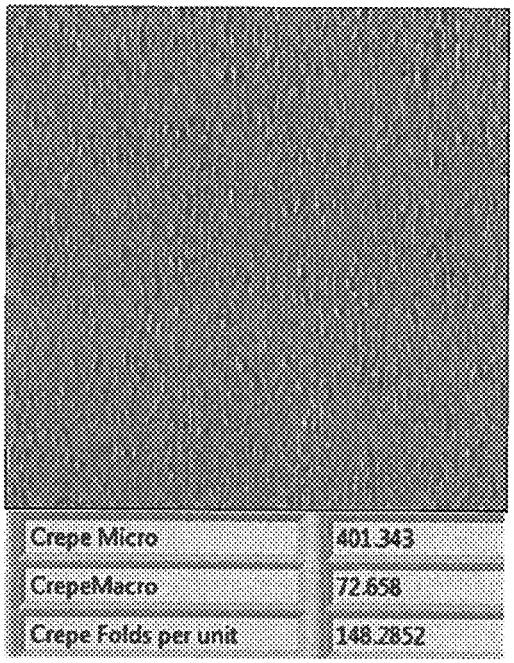
Figure 6C:
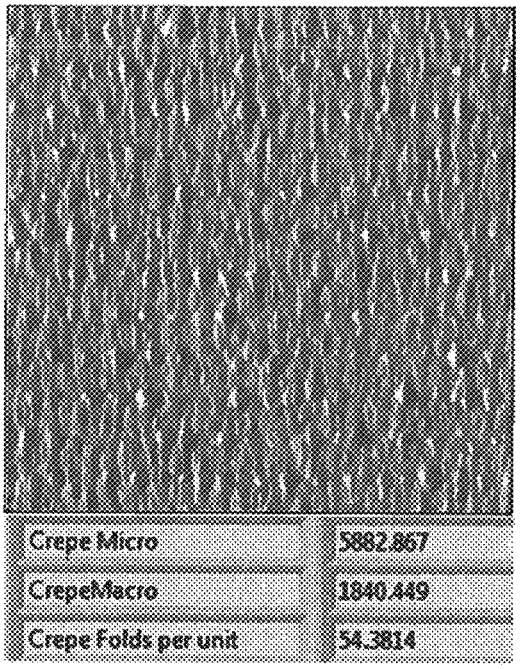

FIGS. 6A through 6C illustrate examples of measuring macro crepe and micro crepe variations for different creped tissue papers according to this disclosure. In each of FIGS. 6A through 6C, a creped tissue paper's texture is shown, along with macro crepe, micro crepe, and fold count values (among other values).

Referring again to FIG. 4, the intensity $I_{reflected}$ of light reflected from the web 254 could be expressed as:

$$I_{reflected} = c\vec{I}_{incident} \cdot \hat{N} = c|\vec{I}_{incident}|\cos\delta \propto I_{incident}\cos\delta \tag{6}$$

When the web 254 is viewed from above (such as when capturing an image with the imaging device 122), the intensity of the reflected light varies over the web. This means graylevels vary in the image, which is caused by variations of the angle δ arising from height differences of the web 254. Based on Equation (6) and the discussion above, it can be shown that, for an ideal Lambertian surface or an ideal creped web whose height varies sinusoidally in the illumination direction, the standard deviation $\sigma_r$ of reflected light intensity over the surface of the web is linearly dependent on both the amplitude A and the frequency f of the height variation. This can be expressed as:

$$\sigma_r \propto Af \tag{7}$$

This can be generalized to cases where a creped web is not perfectly sinusoidal. It is evident that a creped structure-dependent component $C_{CS}$ of the tissue caliper (fold height) is equivalent to the amplitude A of the height variation multiplied by two and that the frequency f is equivalent to the dominant frequency ω. Taking account these, Equation (1) can be rewritten as:

$$C = C_0 + C_{cs} = C_0 + k\frac{\sqrt{\text{Macro Crepe}}}{\text{Folds per unit length}} \tag{8}$$

where k is a grade-dependent constant.

The control unit 210 could therefore analyze an image of a creped tissue paper to identify the dominant folds per unit length (a measure of ω) and the macro crepe value (a measure of $\sigma_r$). By identifying the appropriate $C_0$ and k values (which could be selected based on the tissue paper's grade and other parameters), the control unit 210 can calculate the caliper of the creped tissue paper.

Although FIGS. 3A through 6C illustrate various aspects of creped tissue papers, various changes may be made to FIGS. 3A through 6C. For example, these figures are merely meant to illustrate different examples of creped tissue papers and characteristics of those tissue papers. These figures do not limit the scope of this disclosure to any particular type of creped tissue paper.

Figure 7:
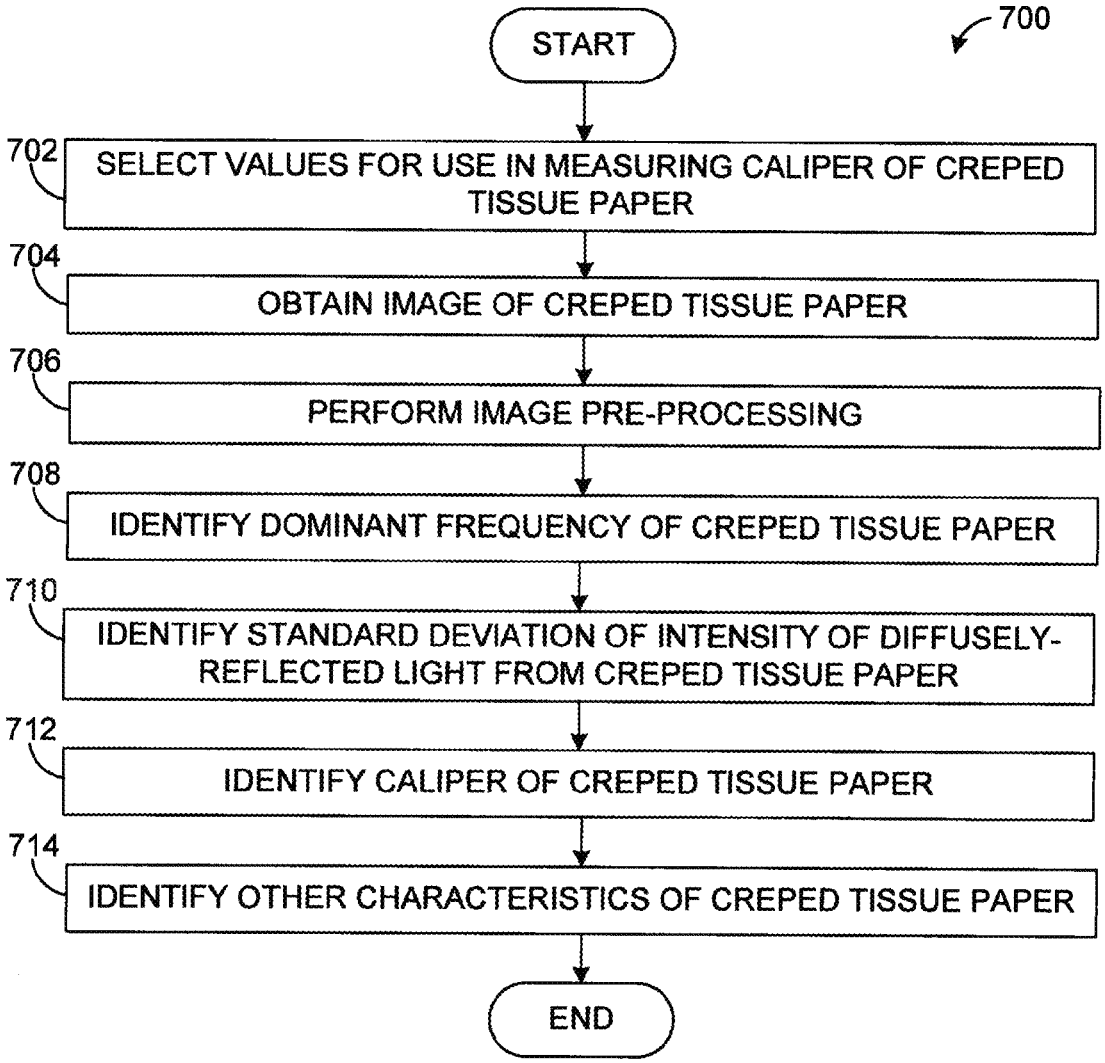
FIG. 7 illustrates an example method for measuring the characteristics of creped tissue paper according to this disclosure.

FIG. 7 illustrates an example method 700 for measuring the characteristics of creped tissue paper according to this disclosure. As shown in FIG. 7, values for use in measuring the caliper of a creped tissue paper are selected at step 702. This could include, for example, the processing device 124 selecting appropriate $C_0$ and $C_{CS}$ parameters for Equation (1) based on the grade of the tissue paper, the crepe percentage, the basis weight of the tissue paper, and one or more characteristics of the stock provided to the headbox 102. As a particular example, this could include the processing device 124 selecting the appropriate $C_0$ and k parameters for Equation (8).

At least one image of the creped tissue paper is obtained at step 704. This could include, for example, the processing device 124 obtaining an image of the web 254 from the imaging device 122. The image can be captured using any suitable illumination from the illumination source 120, such as illumination at an oblique angle (like at substantially 60° to substantially 85° measured normal to the web 254). The image can be captured at any suitable angle, such as substantially normal to the web 254.

Image pre-processing occurs at step 706. This could include, for example, the processing device 124 digitally correcting the image for any unevenness in the illumination of the web 254. This could also include the processing device 124 digitally correcting the image for any tilting of the imaging device 122 or the web 254. Any other or additional optical, geometrical, or statistical corrections could be performed.

The dominant frequency ω of the creped tissue paper is identified at step 708. This could include, for example, the processing device 124 identifying the dominant crepe fold size of the web 254 using the image. This could also include the processing device 124 identifying how many such folds fit within some unit length (such as within one inch). The technique described below can be used to identify the dominant crepe fold size of the web 254.

The standard deviation $\sigma_r$ of the intensity of diffusely-reflected light from the creped tissue paper is identified at step 710. This could include, for example, the processing device 124 identifying the variance of reflected light from larger structures in the crepe texture.

The caliper of the creped tissue paper is identified at step 712. This could include, for example, the processing device 124 using Equation (1) described above to identify the caliper of the web 254. In particular embodiments, this could include the processing device 124 using Equation (8) described above to identify the caliper of the web 254.

Note that during the identification of the caliper of the web 254, the number of folds per unit length and the macro crepe of the web 254 can be identified. One or more other characteristics of the creped tissue paper can also be identified at step 714. This could include, for example, the processing device 124 identifying the micro crepe of the web 254.

Although FIG. 7 illustrates one example of a method 700 for measuring the characteristics of creped tissue paper, various changes may be made to FIG. 7. For example, while shown as a series of steps, various steps in FIG. 7 could overlap, occur in parallel, occur in a different order, or occur multiple times. As a particular example, it is possible to have both pre-processing of the image and post-calculation adjustment to the sensor measurements or other value(s). For instance, adjustments can be made to the dominant fold size, macro crepe, or micro crepe calculations based on optical, geometrical, or statistical corrections.

Figure 8:
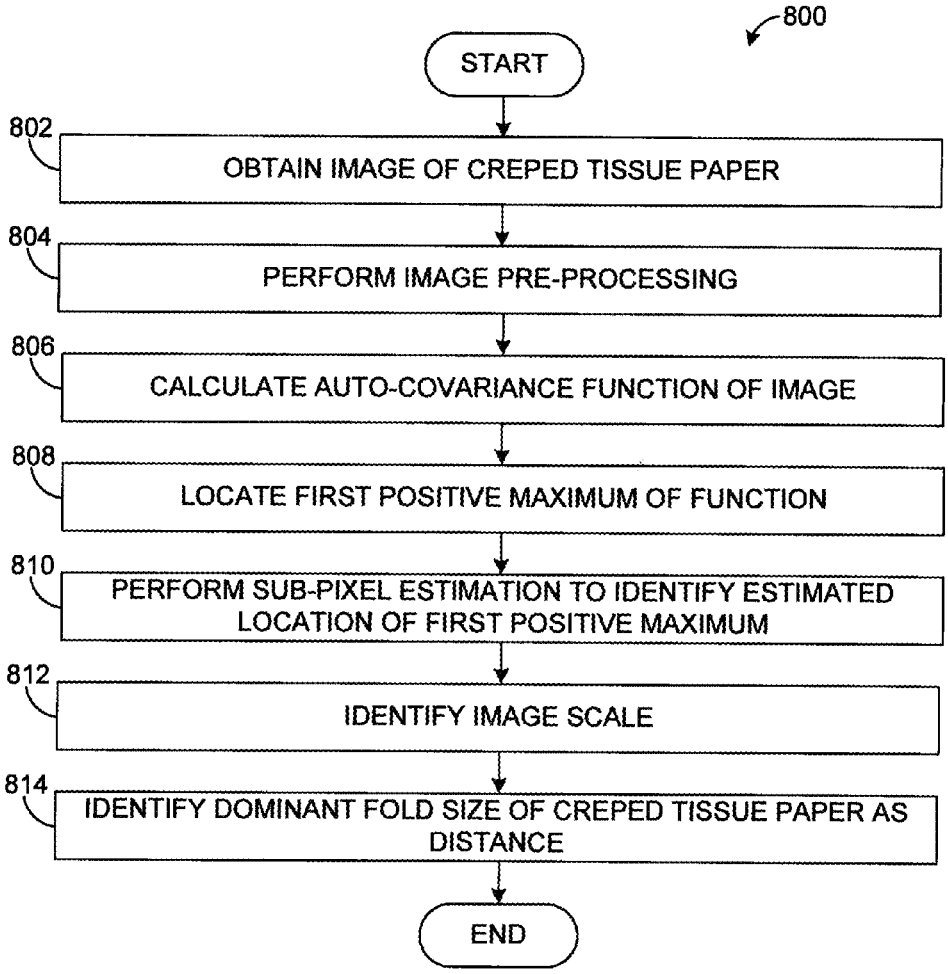
FIG. 8 illustrates an example method for identifying the dominant fold size of creped tissue paper according to this disclosure.

FIG. 8 illustrates an example method 800 for identifying the dominant fold size of creped tissue paper according to this disclosure. The method 800 could, for example, be used to identify the dominant crepe fold size of the web 254, where the dominant crepe fold size is used to identify the dominant frequency ω of the web 254. Note, however, that other approaches for identifying the dominant frequency and/or the dominant crepe fold size of a creped tissue paper could be used.

As shown in FIG. 8, an image of a creped tissue paper is obtained at step 802. This could include, for example, the processing device 124 obtaining an image of the web 254 from the imaging device 122. The image could represent a one-dimensional or multi-dimensional image. In some embodiments, the image can be captured using any suitable illumination, such as annular illumination, oblique illumination, or any other illumination. The image can also be captured at any suitable angle, such as substantially normal to the web 254. In particular embodiments, the image obtained at step 802 could be the same image obtained at step 704 or a different image.

Image pre-processing occurs at step 804. This could include, for example, the processing device 124 digitally correcting the image for any unevenness in the illumination of the web 254. This could also include the processing device 124 digitally correcting the image for any tilting of the imaging device 122 or the web 254. Any other or additional optical, geometrical, or statistical corrections could be performed, such as to compensate for optical aberrations, vignetting, depth of focus, and temperature-dependent noise. In particular embodiments, the image pre-processing at step 804 could be the same image pre-processing at step 706 or different image pre-processing.

An auto-covariance function of the image is identified at step 806. This could include, for example, the processing device 124 generating a discrete auto-covariance function using the pre-processed image data. A discrete auto-covariance function of an image can be determined in various domains, such as the spatial domain or the frequency domain (like after a fast Fourier transform or other transform). A discrete auto-covariance function can be generated to represent the similarity of or relationship between the gray level of adjacent pixels, pixels that are separated by one pixel, pixels that are separated by two pixels, and so on in a particular direction. The direction could represent a row or column of a Cartesian coordinate system or a radial direction of a polar coordinate system. The resulting functions can then be averaged, such as for all rows/columns or in all radial directions, to create a final discrete auto-covariance function. The final auto-covariance function can be defined using a series of discrete points, such as where the discrete points are defined as values between −1 and +1 (inclusive) for whole numbers of pixels.

Note that the phrase "auto-covariance" can be used interchangeably with "auto-correlation" in many fields. In some embodiments, the auto-covariance function represents an auto-covariance function normalized by mean and variance, which is also called an "auto-correlation coefficient."

In particular embodiments, for one-dimensional discrete data, an auto-covariance function (auto-correlation coefficient) in the spatial domain can be expressed as:

$$R(\tau) = \frac{E[(X_t - \mu)(X_{t+\tau} - \mu)]}{\sigma^2} \tag{9}$$

where E denotes an expected value operator, $X_t$ denotes the data value at index (time) t, τ denotes the distance (time lag) between data points, μ denotes the mean value of the data points, and $\sigma^2$ denotes the variance of the data points. In the above equation, a second-order stationary process is assumed.

In other particular embodiments, for two-dimensional discrete data, the auto-covariance function (auto-correlation coefficient) in the spatial domain for the $j^{th}$ row of a two-dimensional gray level image $g_{i,j}$ as a function of pixel distance k can be expressed as:

$$R_j(k) = \frac{1}{(n-k)\sigma^2} \sum_{i=1}^{n-k} (g_{i,j} - \mu)(g_{i+k,j} - \mu) \tag{10}$$

where k is less than n, μ denotes the mean gray level of the image, and $\sigma^2$ denotes the variance in gray level of the image. The average auto-covariance function for the image rows can then be calculated as:

$$\overline{R(k)} = \frac{1}{m}\sum_{i=1}^{m} R_i(k) \tag{11}$$

Note that the mean auto-covariance function (auto-correlation coefficient) as a function pixel distance is not limited to use with rows of pixel data. Rather, it can be calculated with any dimension or direction in an image.

An auto-covariance function in the frequency domain could be computed using the Wiener-Khinchin theorem in a one-dimensional case as:

$$G(f)=\mathrm{FFT}[X_t-\mu] \tag{12}$$

$$S(f)=G(f)G^*(f) \tag{13}$$

$$R(\tau)=\mathrm{IFFT}[S(f)] \tag{14}$$

Here, FFT[ ] denotes a Fast Fourier Transform, IFFT[ ] denotes an Inverse Fast Fourier Transform, and G* denotes the complex conjugate of G. This technique can also be used in each row, column, or other direction of a two-dimensional image. An average of the auto-covariance functions of multiple lines can be computed to obtain the average auto-covariance function of an image efficiently. This technique can be applied to any discrete data with any dimension or direction.

A position of the first positive local maximum of the auto-covariance function (when moving away from the origin) is identified at step 808. This could include, for example, the processing device 124 identifying a positive number of whole pixels associated with the first positive local maximum of the auto-covariance function. This position can be denoted $x_p$.

Sub-pixel estimation is performed to identify a more accurate position of the first positive local maximum of the auto-covariance function at step 810. This could include, for example, the processing device 124 performing a curve-fitting algorithm using the discrete points at and around the $x_p$ position to identify a fitted polynomial. As a particular example, the processing device 124 could fit a second-order polynomial to the discrete point at the $x_p$ position and the discrete points closest to the $x_p$ position. The maximum value of the fitted polynomial is identified, and the position of that maximum value is used as the sub-pixel estimate of the auto-covariance function. The sub-pixel estimate represents the dominant crepe fold size contained in the obtained image expressed as a number of pixels (both whole and fractional pixels).

If desired, the dominant crepe fold size expressed as a number of pixels could be converted into a measure of distance. To do this, an image scale is identified at step 812. This could include, for example, the processing device 124 determining a real-world distance corresponding to each pixel in the obtained image. The real-world distance can be based on various factors, such as the distance of the imaging device 122 from the web 254, the focal length and zoom of the imaging device 122 when the image was captured, and the chip or sensor type of the imaging device 122. The real-world distance can also be determined using a calibration target of a known size. The dominant crepe fold size in terms of distance is identified at step 814. This could include, for example, the processing device 124 multiplying the sub-pixel estimate identified earlier (which represents the dominant crepe fold size expressed as a number of pixels) and the image scale (which represents the distance each pixel represents). The resulting value expresses the dominant crepe fold size as a measure of length. Note, however, that this is optional, and the dominant crepe fold size expressed as a number of pixels could be used to identify the caliper of the web 254.

Although FIG. 8 illustrates one example of a method 800 for identifying the dominant fold size of creped tissue paper, various changes may be made to FIG. 8. For example, while shown as a series of steps, various steps in FIG. 8 could overlap, occur in parallel, occur in a different order, or occur multiple times. As a particular example, it is possible to have both pre-processing of the image and post-calculation adjustment to the dominant crepe fold size.

Figure 9A:
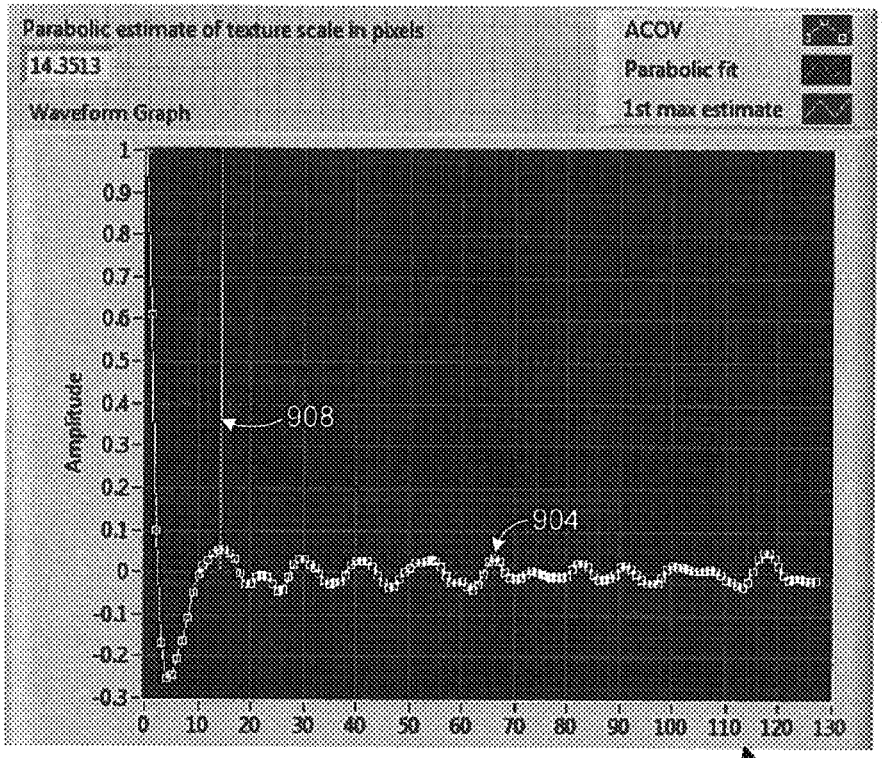
FIGS. 9A and 9B illustrate an example of identifying the dominant fold size of creped tissue paper according to this disclosure.
Figure 9B:
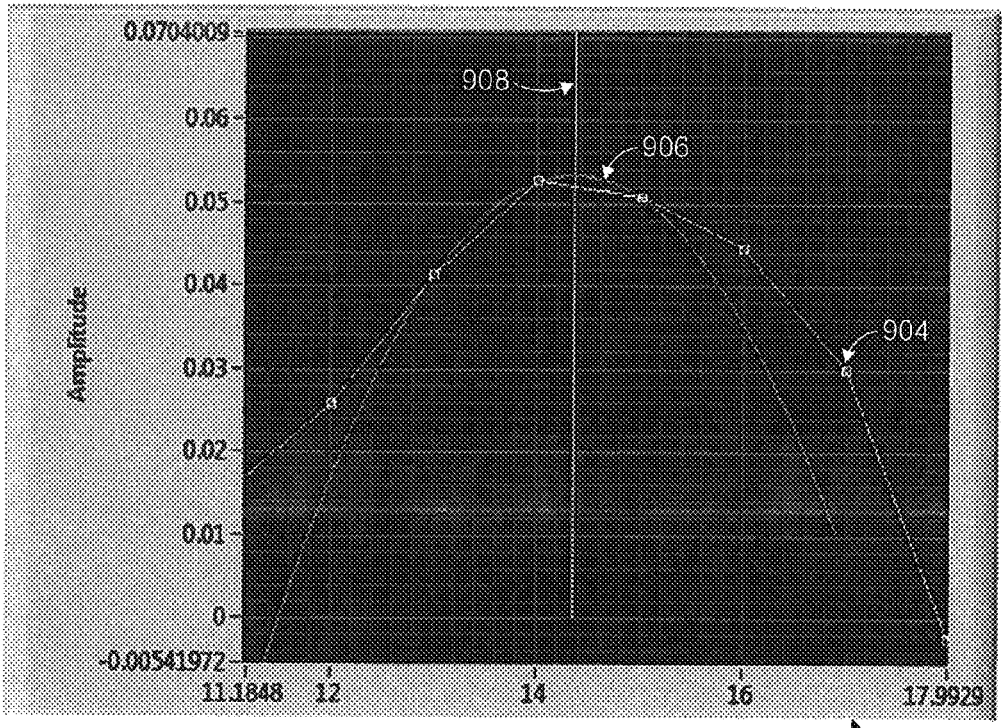

FIGS. 9A and 9B illustrate an example of identifying the dominant fold size of creped tissue paper according to this disclosure. In FIGS. 9A and 9B, two graphs 900-902 could be generated using the image of the creped tissue paper shown in FIG. 5B. In FIG. 9A, the graph 900 includes various discrete points 904, which represent the values of a discrete auto-covariance function. As can be seen here, the first positive local maximum that is encountered when moving away from the origin occurs at a pixel distance of 14. The processing device 124 then fits a polynomial curve 906 against the point 904 at that pixel distance and its neighboring points 904. The maximum value of the polynomial curve 906 is denoted with a line 908, which also represents the dominant crepe fold size expressed in terms of pixels. In this example, the dominant crepe fold size represents 14.3513 pixels. By calculating the distance per pixel, the dominant crepe fold size can optionally be expressed as a length.

Although FIGS. 9A and 9B illustrate one example of identifying the dominant fold size of creped tissue paper, various changes may be made to FIGS. 9A and 9B. For instance, this example is for illustration only and does not limit the system 100 of FIG. 1 or the methods 600, 800 of FIGS. 6 and 8 to any particular implementation.

The number of folds per unit length, caliper, macro crepe, and/or micro crepe values associated with the web 254 can be used to adjust the manufacturing process of the web 254. This allows greater control over the crepe structure of the final creped tissue paper being manufactured.

In the following discussion, two directions are referenced with respect to the web 254 of creped tissue paper being manufactured. The "machine direction" (MD) refers to the direction along the longer length of the web 254. The "cross direction" (CD) refers to the direction across the shorter width of the web 254. MD control of a characteristic indicates that a controller 130 or other device can vary the characteristic along the length of the web 254. CD control of a characteristic indicates that a controller 130 or other device can vary the characteristic across the width of the web 254. A "profile" refers to a collection of values for a characteristic across the width of the web 254.

Figure 10:
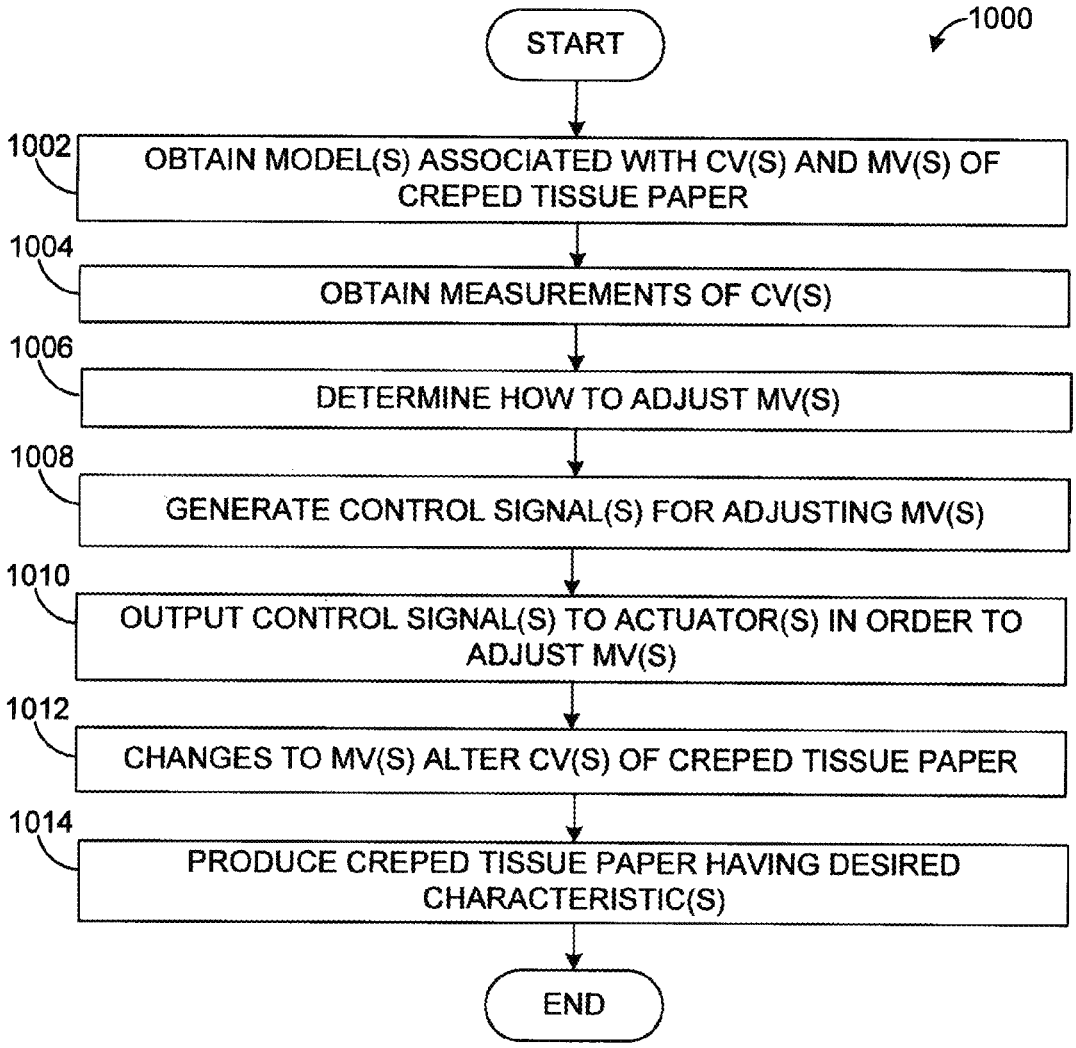
FIG. 10 illustrates an example method for closed-loop control of creped tissue paper structure according to this disclosure.

FIG. 10 illustrates an example method 1000 for closed-loop control of creped tissue paper structure according to this disclosure. While the method 1000 is described as using measurements from the sensor 200, the method 1000 could be used with any suitable sensor(s) capable of measuring one or more characteristics of a web of creped tissue paper.

As shown in FIG. 10, at least one model associated with one or more controlled variables (CVs) and one or more manipulated variables (MVs) is obtained at step 1002. This could include, for example, the processing device 132 in the controller 130 obtaining at least one model from an operator or model generation tool. A controlled variable generally represents a variable that can be measured or inferred and that is ideally controlled to be at or near a desired setpoint or within a desired range of values. A manipulated variable generally represents a variable that can be adjusted in order to alter one or more controlled variables. In some embodiments, the manipulated variables include the crepe percentage, the creping blade angle, the addition of sizing agent, and the profile of sizing agent in the system 100 of FIG. 1. Also, in some embodiments, the controlled variables include the number of folds per unit length, the caliper, the macro crepe, and the micro crepe of the web 254. In particular embodiments, multiple models can be used, where each model associates a single controlled variable with a single manipulated variable.

Measurements of one or more controlled variables are obtained at step 1004. This could include, for example, the processing device 132 in the controller 130 obtaining measurements of the number of folds per unit length, the caliper, the macro crepe, and the micro crepe of the web 254 from the scanner 118 (which could include the sensor 200). As noted above, however, the controller 130 itself or another component could generate at least some of the measurements, such as by using images of the web 254 captured by the scanner 118.

A determination is made how to adjust one or more manipulated variables at step 1006, and one or more control signals for adjusting the one or more manipulated variables are generated at step 1008. This could include, for example, the processing device 132 in the controller 130 using the model(s) and the measurements of the controlled variable(s) to determine how to adjust the manipulated variable(s). For instance, the controller 130 could elect to alter a single manipulated variable in order to adjust one or more controlled variables, alter multiple manipulated variables in order to adjust a single controlled variable, or alter multiple manipulated variables in order to adjust multiple controlled variables. In some embodiments, the controller 130 can implement a model predictive control (MPC) or other multi-variable control technique in order to determine how to adjust manipulated variables in order to control controlled variables.

The one or more control signals are output to one or more actuators in order to adjust the manipulated variable(s) at step 1010. The one or more control signals alter the one or more controlled variables of the creped tissue paper at step 1012. Ideally, this allows the production of creped tissue paper having one or more desired characteristics at step 1014. For example, the web 254 ideally has a desired crepe structure.

Although FIG. 10 illustrates one example of a method 1000 for closed-loop control of creped tissue paper structure, various changes may be made to FIG. 10. For example, while shown as a series of steps, various steps in FIG. 10 could overlap, occur in parallel, occur in a different order, or occur multiple times. As a particular example, steps 1004-1012 could generally overlap and occur repeatedly over time in order to maintain prolonged control of the characteristic(s) of the web 254.

As noted above, the creping doctor 112 is used to remove the dried web 254 of creped tissue paper from the Yankee dryer 110. The blade of the creping doctor 112 can contact the Yankee dryer 110 and become worn over time. As a result, the blade of the creping doctor 112 needs replacement from time to time. It has been determined that the number of folds per unit length of the web 254 (such as the number of crepe folds per inch) and the caliper of the web 254 are affected by changes to the blade of the creping doctor 112. More specifically, when the blade of the creping doctor 112 is replaced, the number of folds per unit length jumps to a high value and then gradually decreases as the blade wears. Conversely, the caliper is affected in the opposite manner. When the blade of the creping doctor 112 is replaced, the high number of folds per unit length results in folds having lower amplitude(s), so the web 254 has a lower caliper. As the number of folds per unit length gradually decreases, the folds gradually develop larger amplitude(s), so the web 254 has a larger caliper. Thus, caliper is typically at a low quality limit when the blade is replaced and at a high quality limit near the blade's end of life.

The number of folds per unit length, the caliper, the macro crepe, and/or the micro crepe of the web 254 can be controlled by adjusting the crepe percentage and/or the blade angle of the creping doctor 112. By adjusting the crepe percentage and/or the blade angle of the creping doctor 112, it is possible to adjust the number of folds per unit length, caliper, macro crepe, and/or micro crepe of the finished web 254 so that those values are closer to their desired or optimal values. Among other things, this can help to enable a longer operational lifespan of the creping doctor blade while maintaining desired quality parameters of the finished web 254. Increasing the lifespan of the creping doctor blade can result in longer operating times between blade breaks/replacements, resulting in monetary savings and improved up-time of the system 100.

Moreover, as noted above, a sizing agent can be sprayed onto the Yankee dryer 110 just before the wet web of fibers attaches to the Yankee dryer 110. The amount of sizing agent affects how the creping doctor blade removes the dried web 254 from the surface of the Yankee dryer 110. Varying the amount of sizing agent can therefore result in different crepe structures. As a result, the amount of sizing agent is another variable that can be used to control the crepe structure (number of folds per unit length, caliper, macro crepe, and micro crepe) of the finished web 254. For example, the total amount of sizing agent used in the machine direction can be used to control the number of folds per unit length, caliper, macro crepe, and/or micro crepe of the web 254 in the machine direction. As another example, the profile of sizing agent used in the cross direction can be used to control the number of folds per unit length, caliper, macro crepe, and/or micro crepe profile of the web 254 in the cross direction.

In some embodiments, the controller 130 can implement any one of the following control actions in the system 100 or any combination thereof:

closed-loop MD control of the number of folds per unit length based on adjusting the crepe percentage;

closed-loop MD control of caliper based on adjusting the crepe percentage;

closed-loop MD control of micro crepe based on adjusting the crepe percentage;

closed-loop MD control of macro crepe based on adjusting the crepe percentage;

closed-loop MD control of the number of folds per unit length based on adjusting the creping blade angle;

closed-loop MD control of caliper based on adjusting the creping blade angle;

closed-loop MD control of micro crepe based on adjusting the creping blade angle;

closed-loop MD control of macro crepe based on adjusting the creping blade angle;

closed-loop MD control of the number of folds per unit length based on adjusting the addition of sizing agent in the machine direction;

closed-loop MD control of caliper based on adjusting the addition of sizing agent in the machine direction;

closed-loop MD control of micro crepe based on adjusting the addition of sizing agent in the machine direction;

closed-loop MD control of macro crepe based on adjusting the addition of sizing agent in the machine direction;

closed-loop CD control of the number of folds per unit length profile based on adjusting the sizing agent profile in the cross direction;

closed-loop CD control of the caliper profile based on adjusting the sizing agent profile in the cross direction;

closed-loop CD control of the micro crepe profile based on adjusting the sizing agent profile in the cross direction; and closed-loop CD control of the macro crepe profile based on adjusting the sizing agent profile in the cross direction.

Each one of these control actions is described below.

In some embodiments, each control action listed here can be implemented using a mathematical model that associates a controlled variable to changes in a manipulated variable. The controlled variable in each control action is the variable being controlled, and the manipulated variable in each control action is the variable being adjusted. Each model could be generated in any suitable manner known in the art, such as via step-testing or with historical data. The models can be used by an MPC controller, a multi-variable control device, or other suitable controller(s) for controlling the various controlled variables based on modifications to manipulated variables.

FIGS. 11 through 26 illustrate examples of closed-loop control techniques for creped tissue paper structure according to this disclosure. For ease of explanation, these control techniques can be implemented using one or multiple controllers 130 based on measurements from one or multiple scanners 118 in the system 100 of FIG. 1. However, these control techniques could be implemented using any suitable controller(s) based on measurements from any suitable sensor(s) in any suitable system.

Figure 11:
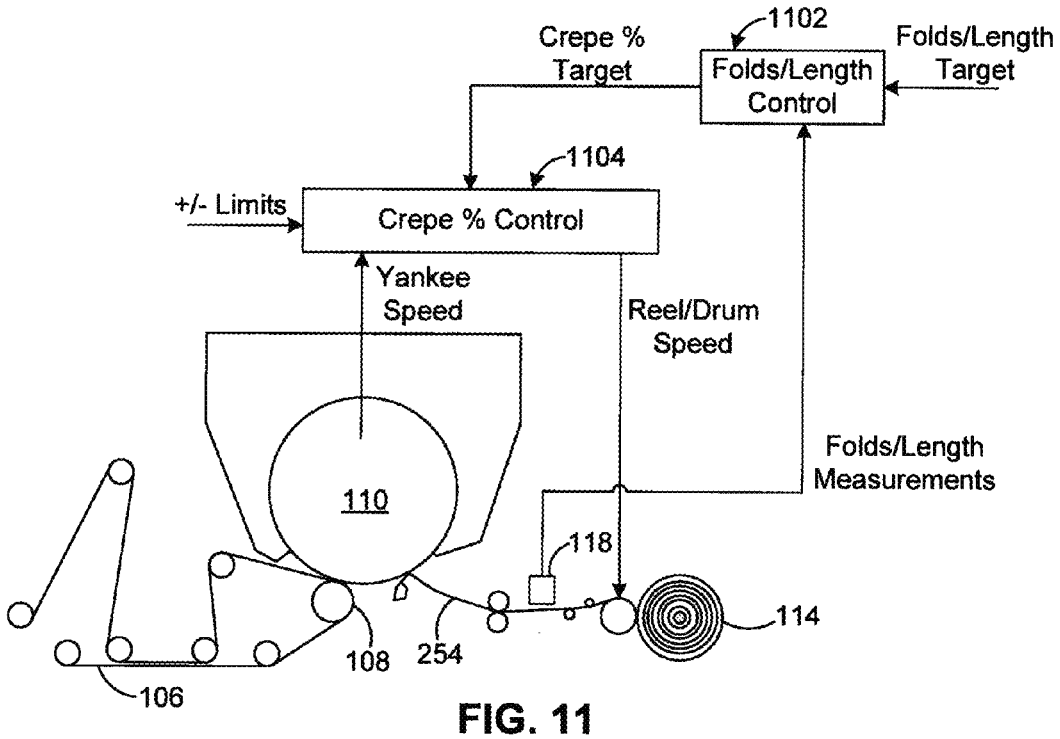
FIGS. 11 through 26 illustrate examples of closed-loop control techniques for creped tissue paper structure according to this disclosure.

In FIG. 11, measurements of the number of folds per unit length (folds/length) of a web 254 are provided from the scanner 118 to a folds/length control unit 1102. The control unit 1102 also receives a target value for the number of folds per unit length, which could come from any suitable source (such as a higher-level controller or operator). The control unit 1102 uses the folds/length measurements to determine how to adjust a crepe percentage target in order to achieve the desired target folds/length value, such as by using a model that associates the folds/length and crepe percentage. The crepe percentage target represents a target value for the crepe percentage, which can be defined in Equation (2) above.

A crepe percentage control unit 1104 receives the crepe percentage target and measurements of the rotational speed of the Yankee dryer 110. The control unit 1104 uses this information to determine how to adjust the rotational speed of the reel or drum 114 in order to achieve the target crepe percentage. In this way, the folds/length measurements ideally converge to or near the folds/length target.

Figure 12:
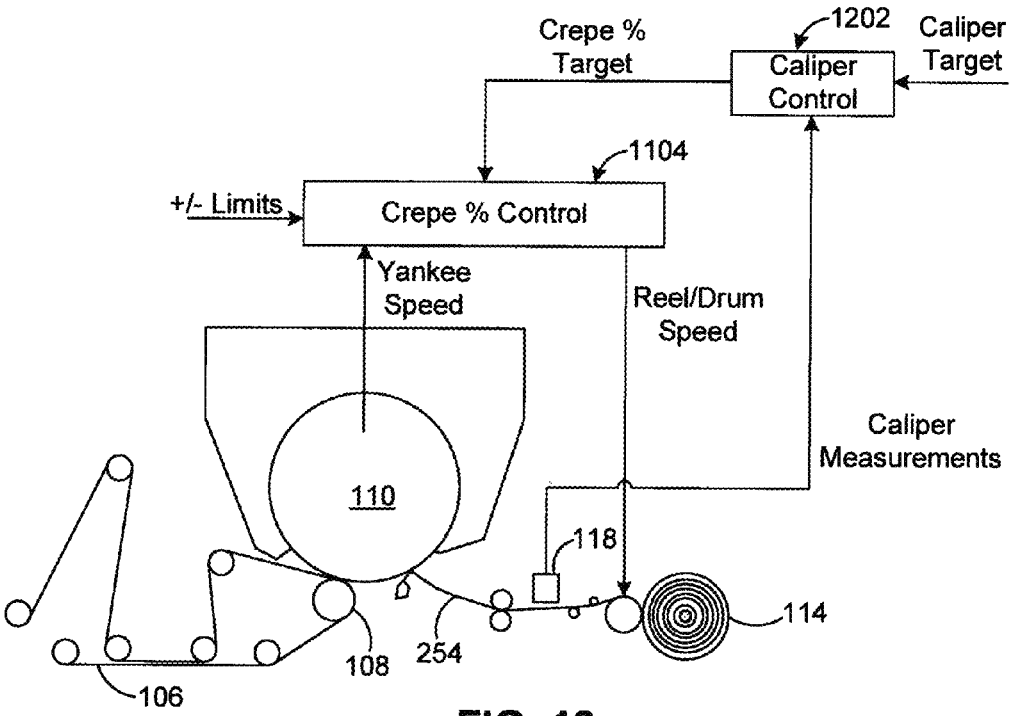

In FIG. 12, measurements of the caliper of the web 254 are provided from the scanner 118 to a caliper control unit 1202. The control unit 1202 also receives a target value for the caliper, which could come from any suitable source. The control unit 1102 uses the caliper measurements to determine how to adjust a crepe percentage target in order to achieve the desired target caliper value, such as by using a model that associates the caliper and crepe percentage. The crepe percentage control unit 1104 uses the crepe percentage target to adjust the rotational speed of the reel or drum 114 in order to achieve the target crepe percentage. In this way, the caliper measurements ideally converge to or near the caliper target.

Figure 13:
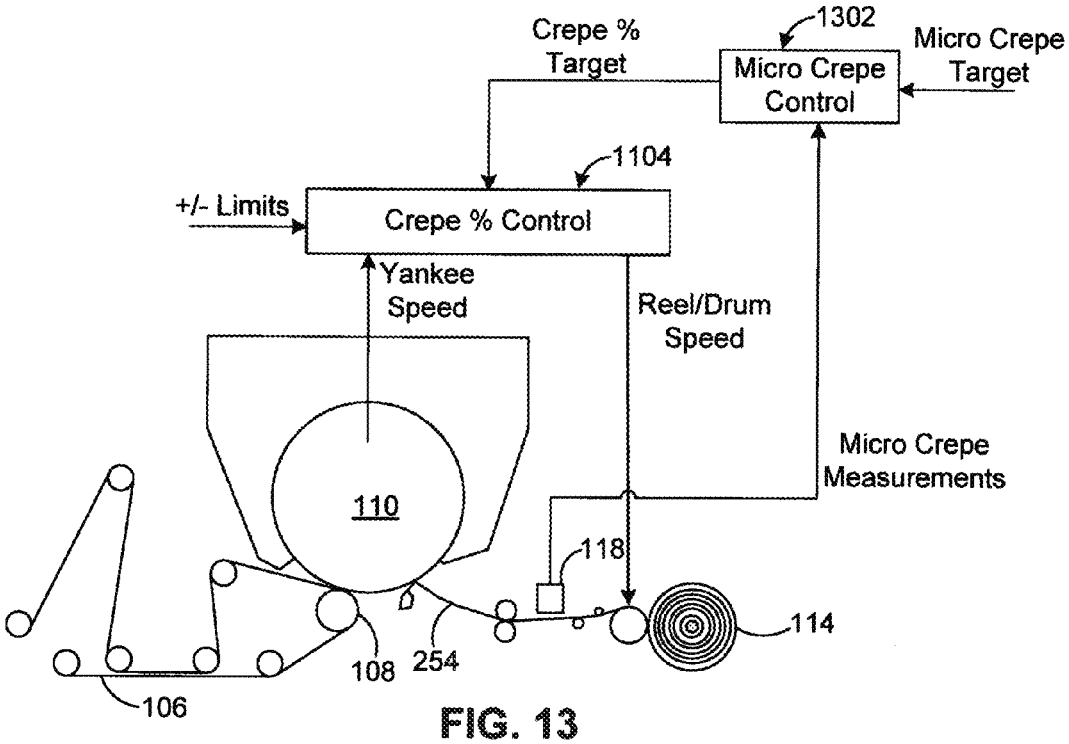

In FIG. 13, measurements of the micro crepe of the web 254 are provided from the scanner 118 to a micro crepe control unit 1302. The control unit 1302 also receives a target value for the micro crepe, which could come from any suitable source. The control unit 1302 uses the micro crepe measurements to determine how to adjust a crepe percentage target in order to achieve the desired target micro crepe value, such as by using a model that associates the micro crepe and crepe percentage. The crepe percentage control unit 1104 uses the crepe percentage target to adjust the rotational speed of the reel or drum 114 in order to achieve the target crepe percentage. In this way, the micro crepe measurements ideally converge to or near the micro crepe target.

Figure 14:
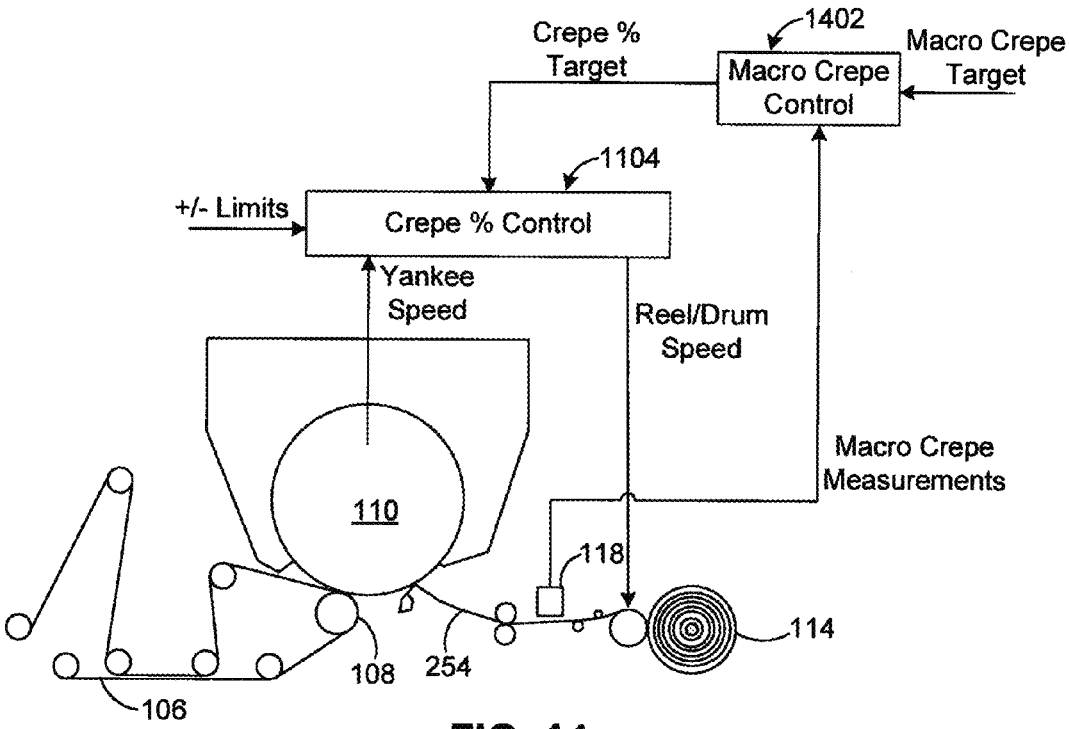

In FIG. 14, measurements of the macro crepe of the web 254 are provided from the scanner 118 to a macro crepe control unit 1402. The control unit 1402 also receives a target value for the macro crepe, which could come from any suitable source. The control unit 1402 uses the macro crepe measurements to determine how to adjust a crepe percentage target in order to achieve the desired target macro crepe value, such as by using a model that associates the macro crepe and crepe percentage. The crepe percentage control unit 1104 uses the crepe percentage target to adjust the rotational speed of the reel or drum 114 in order to achieve the target crepe percentage. In this way, the macro crepe measurements ideally converge to or near the macro crepe target.

Figure 15:
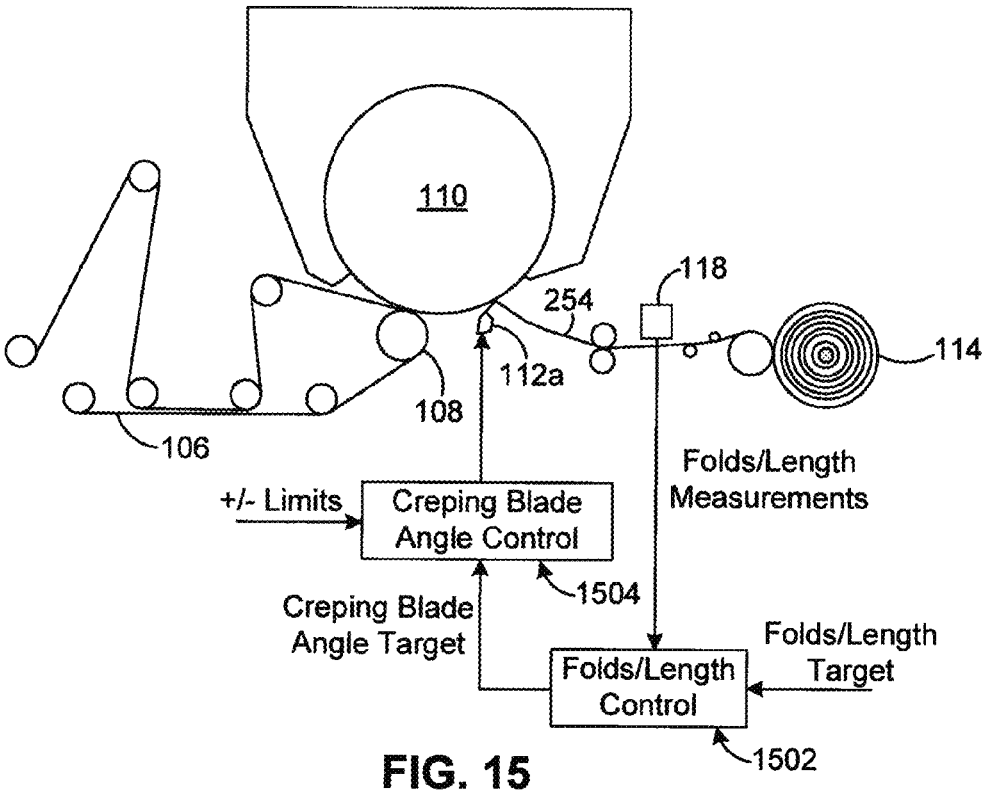

In FIG. 15, measurements of the folds/length of the web 254 are provided from the scanner 118 to a folds/length control unit 1502. The control unit 1502 also receives a target value for the folds/length, which could come from any suitable source. The control unit 1502 uses the folds/length measurements to determine how to adjust a creping blade angle target in order to achieve the desired target folds/length value, such as by using a model that associates the folds/length and creping blade angle. The creping blade angle target represents a target value for the angle of a creping blade 112*a*, which forms part of the creping doctor 112.

A creping blade angle control unit 1504 receives the creping blade angle target and adjusts the angle of the creping blade 112*a* in order to achieve the target angle. In this way, the folds/length measurements ideally converge to or near the folds/length target.

Figure 16:
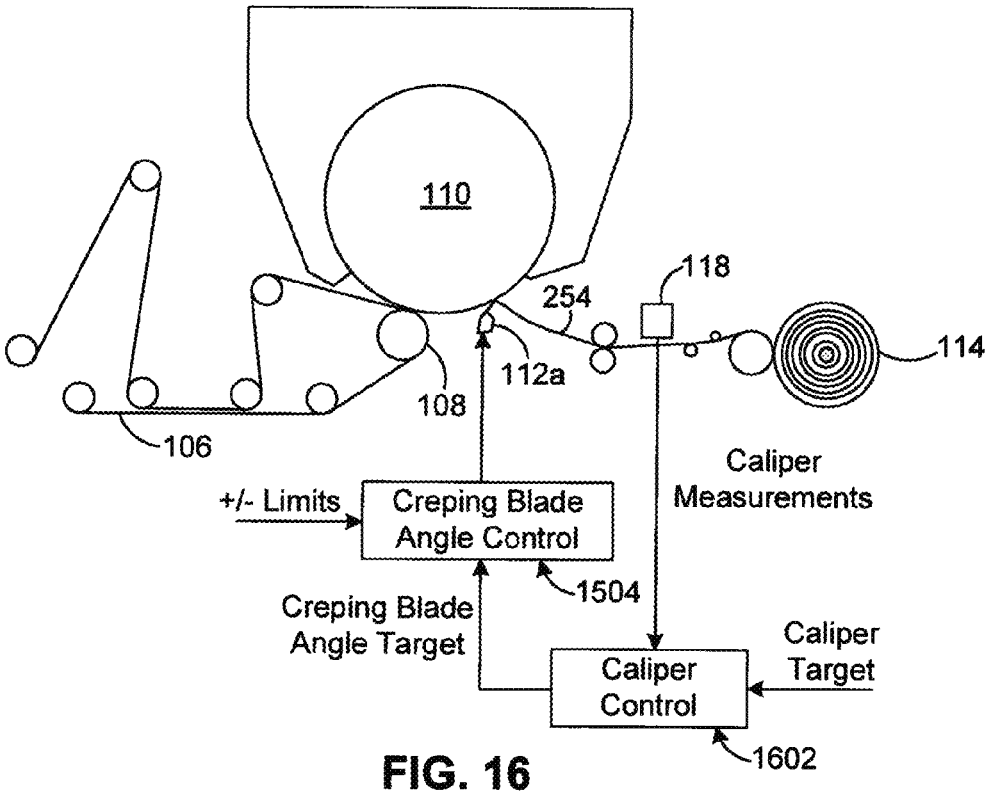

In FIG. 16, measurements of the caliper of the web 254 are provided from the scanner 118 to a caliper control unit 1602. The control unit 1602 also receives a target value for the caliper, which could come from any suitable source. The control unit 1602 uses the caliper measurements to determine how to adjust a creping blade angle target in order to achieve the desired target caliper value, such as by using a model that associates the caliper and creping blade angle. The creping blade angle control unit 1504 receives the creping blade angle target and adjusts the angle of the creping blade 112*a* in order to achieve the target angle. In this way, the caliper measurements ideally converge to or near the caliper target.

Figure 17:
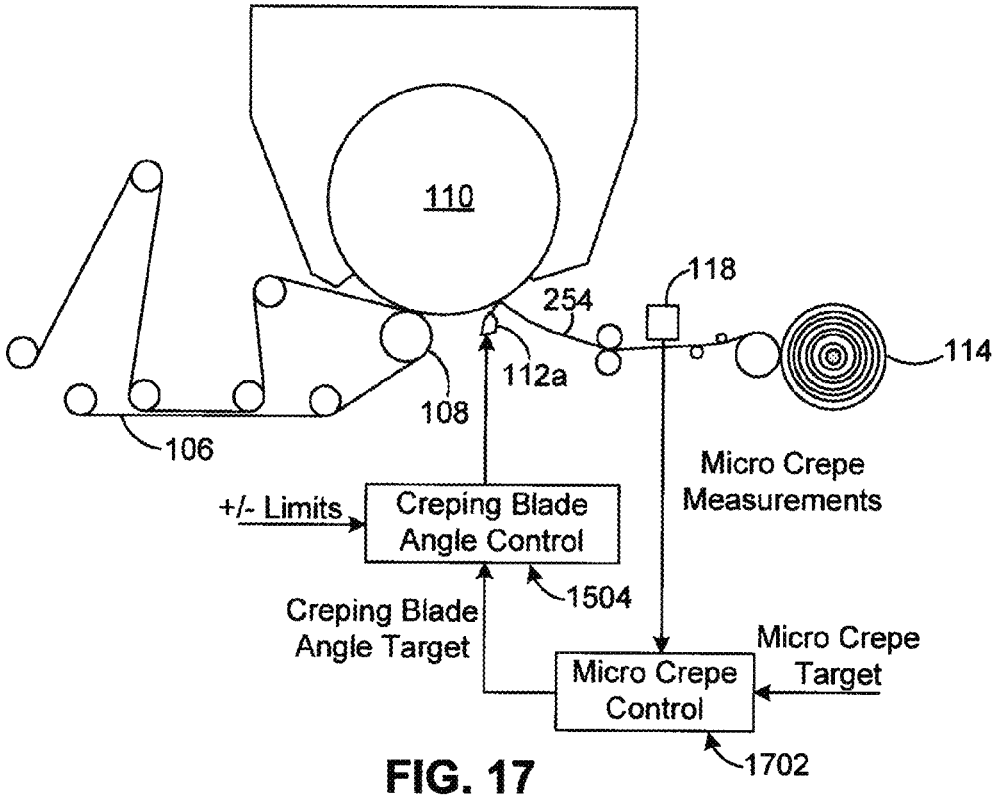

In FIG. 17, measurements of the micro crepe of the web 254 are provided from the scanner 118 to a micro crepe control unit 1702. The control unit 1702 also receives a target value for the micro crepe, which could come from any suitable source. The control unit 1702 uses the micro crepe measurements to determine how to adjust a creping blade angle target in order to achieve the desired target micro crepe value, such as by using a model that associates the micro crepe and creping blade angle. The creping blade angle control unit 1504 receives the creping blade angle target and adjusts the angle of the creping blade 112*a* in order to achieve the target angle. In this way, the micro crepe measurements ideally converge to or near the micro crepe target.

Figure 18:
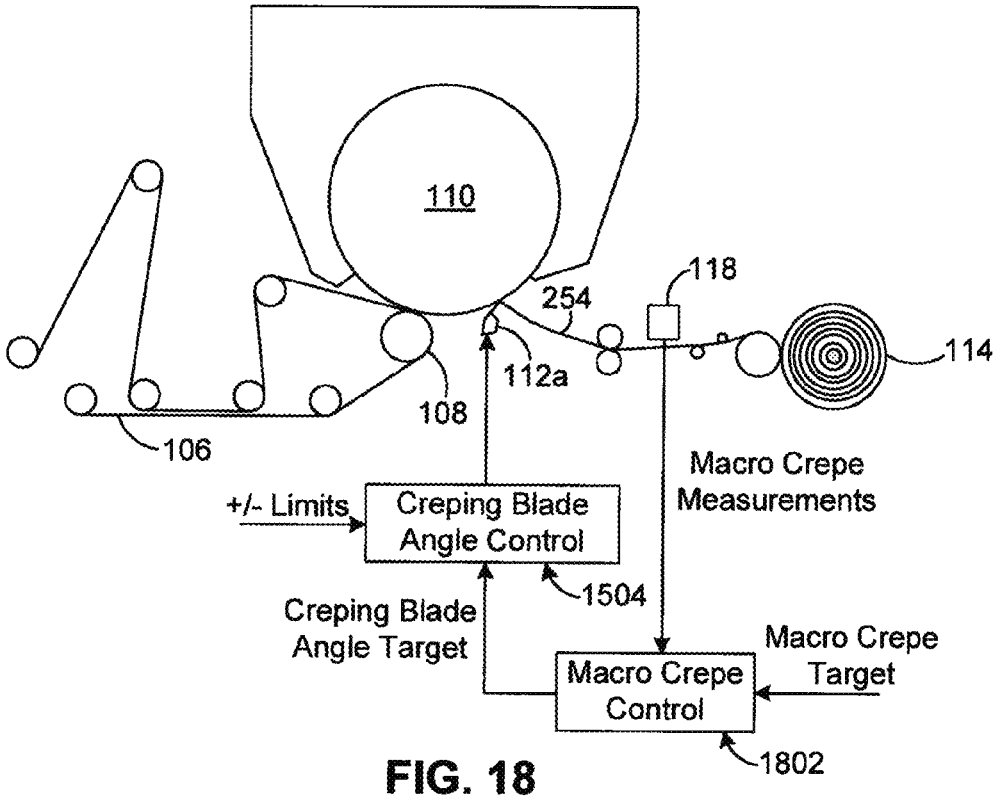

In FIG. 18, measurements of the macro crepe of the web 254 are provided from the scanner 118 to a macro crepe control unit 1802. The control unit 1802 also receives a target value for the macro crepe, which could come from any suitable source. The control unit 1802 uses the macro crepe measurements to determine how to adjust a creping blade angle target in order to achieve the desired target macro crepe value, such as by using a model that associates the macro crepe and creping blade angle. The creping blade angle control unit 1504 receives the creping blade angle target and adjusts the angle of the creping blade 112*a* in order to achieve the target angle. In this way, the macro crepe measurements ideally converge to or near the macro crepe target.

Figure 19:
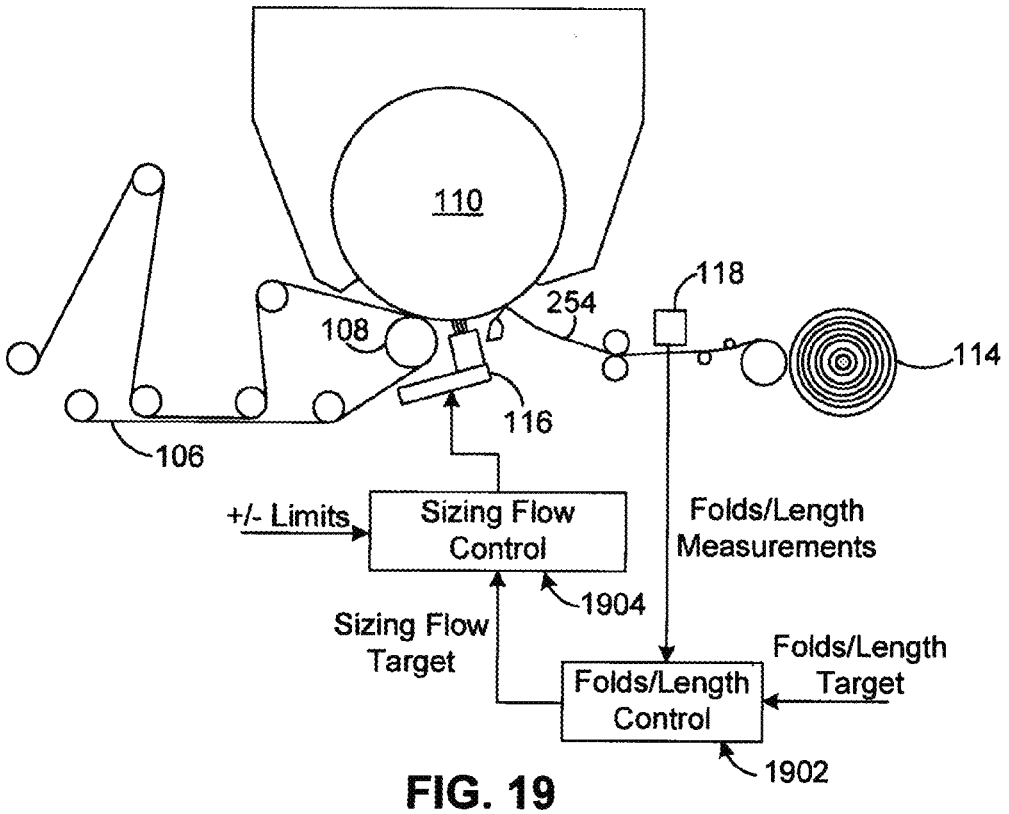

In FIG. 19, measurements of the folds/length of the web 254 are provided from the scanner 118 to a folds/length control unit 1902. The control unit 1902 also receives a target value for the folds/length, which could come from any suitable source. The control unit 1902 uses the folds/length measurements to determine how to adjust a sizing flow target in order to achieve the desired target folds/length value, such as by using a model that associates the folds/length and sizing flow. The sizing flow target represents a target value for a total flow of sizing agent to be delivered by the spray boom 116 (the total flow denotes the total amount of sizing agent delivered by all nozzles in all zones of the spray boom 116 at a given time).

A sizing flow control unit 1904 receives the sizing flow target and adjusts the operation of the spray boom 116 in order to achieve the target flow. In this way, the folds/length measurements ideally converge to or near the folds/length target.

Figure 20:
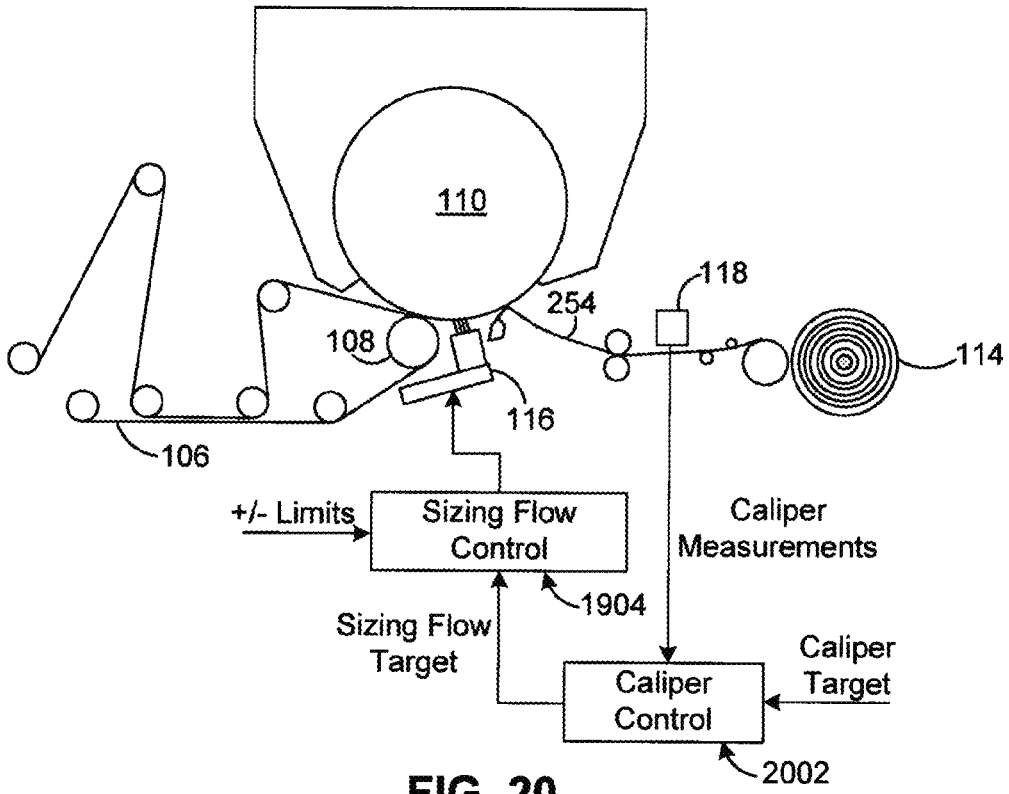

In FIG. 20, measurements of the caliper of the web 254 are provided from the scanner 118 to a caliper control unit 2002. The control unit 2002 also receives a target value for the caliper, which could come from any suitable source. The control unit 2002 uses the caliper measurements to determine how to adjust a sizing flow target in order to achieve the desired target caliper value, such as by using a model that associates the caliper and sizing flow. The sizing flow control unit 1904 receives the sizing flow target and adjusts the operation of the spray boom 116 in order to achieve the target flow. In this way, the caliper measurements ideally converge to or near the caliper target.

Figure 21:
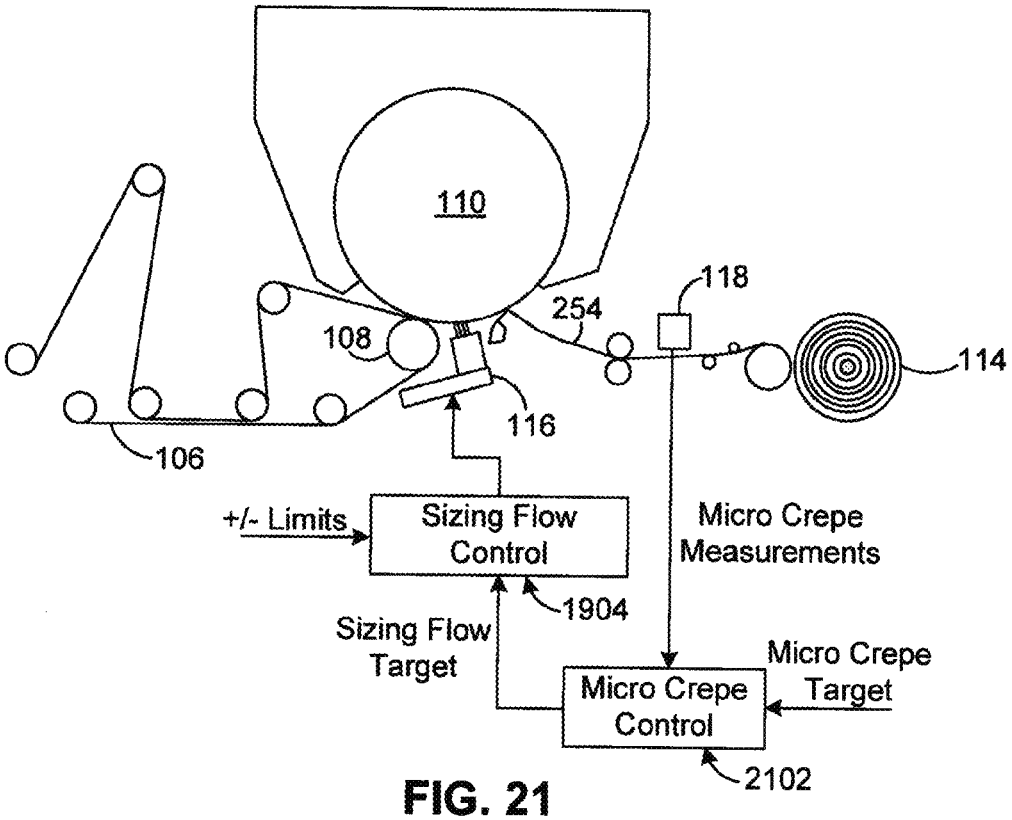

In FIG. 21, measurements of the micro crepe of the web 254 are provided from the scanner 118 to a micro crepe control unit 2102. The control unit 2102 also receives a target value for the micro crepe, which could come from any suitable source. The control unit 2102 uses the micro crepe measurements to determine how to adjust a sizing flow target in order to achieve the desired target micro crepe value, such as by using a model that associates the micro crepe and sizing flow. The sizing flow control unit 1904 receives the sizing flow target and adjusts the operation of the spray boom 116 in order to achieve the target flow. In this way, the micro crepe measurements ideally converge to or near the micro crepe target.

Figure 22:
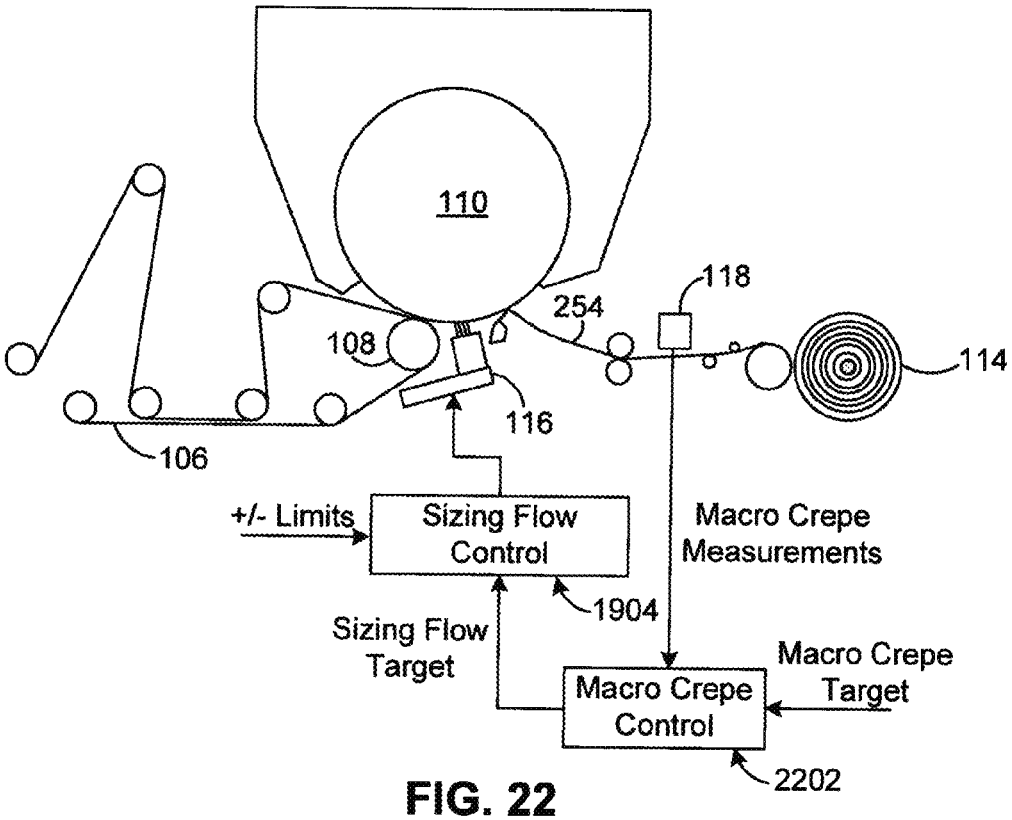

In FIG. 22, measurements of the macro crepe of the web 254 are provided from the scanner 118 to a macro crepe control unit 2202. The control unit 2202 also receives a target value for the macro crepe, which could come from any suitable source. The control unit 2202 uses the macro crepe measurements to determine how to adjust a sizing flow target in order to achieve the desired target macro crepe value, such as by using a model that associates the macro crepe and sizing flow. The sizing flow control unit 1904 receives the sizing flow target and adjusts the operation of the spray boom 116 in order to achieve the target flow. In this way, the macro crepe measurements ideally converge to or near the macro crepe target.

Figure 23:
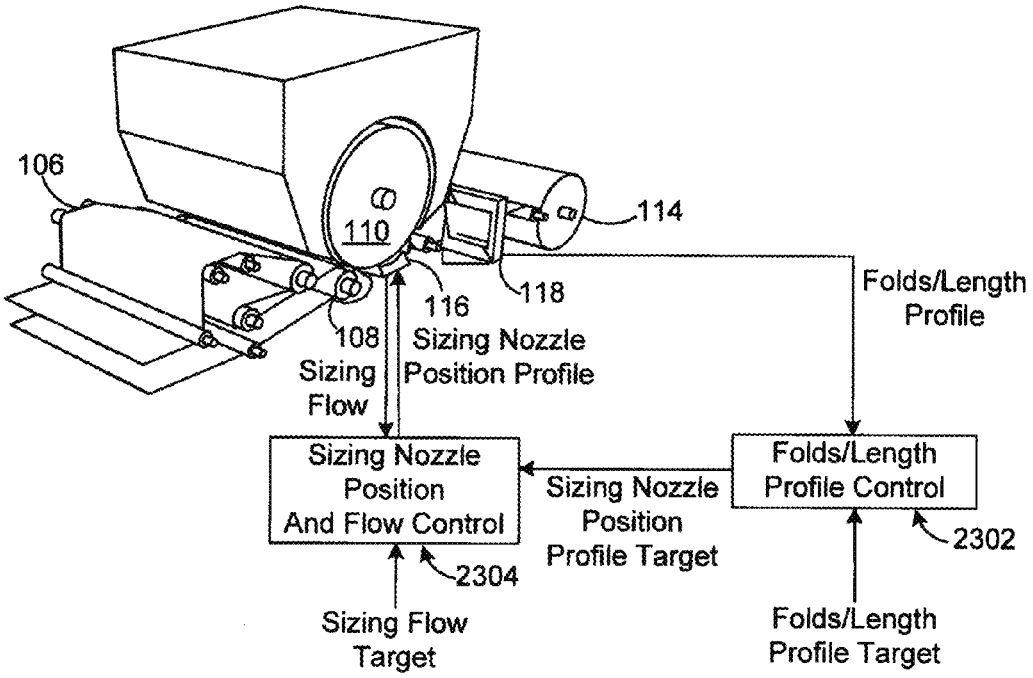

In FIG. 23, a profile of folds/length measurements of the web 254 are provided from the scanner 118 to a folds/length profile control unit 2302. The profile here represents a collection of folds/length measurements across the width of the web 254 in the cross direction, where each measurement is associated with a different portion or zone of the web 254. The control unit 2302 also receives a profile target for the folds/length, which could come from any suitable source. The profile target identifies the target folds/length value for each portion or zone of the web 254.

The control unit 2302 uses the folds/length measurement profile to determine how to adjust a sizing nozzle position profile target, such as by using a model that associates folds/lengths and sizing nozzle positions. As noted above, the spray boom 116 can be implemented using multiple nozzles distributed in the cross direction of the web 254. The sizing nozzle position profile target identifies the target value of the sizing nozzle in each portion or zone across the web 254.

A sizing nozzle position and flow control unit 2304 receives the nozzle position profile target, measurements of the flow of sizing agent through the spray boom 116, and a sizing flow target. The control unit 2304 uses this information to adjust the operation of the nozzles in the spray boom 116 in order to achieve the target nozzle position profile. In this way, the folds/length measurements ideally converge to or near the folds/length target.

Figure 24:
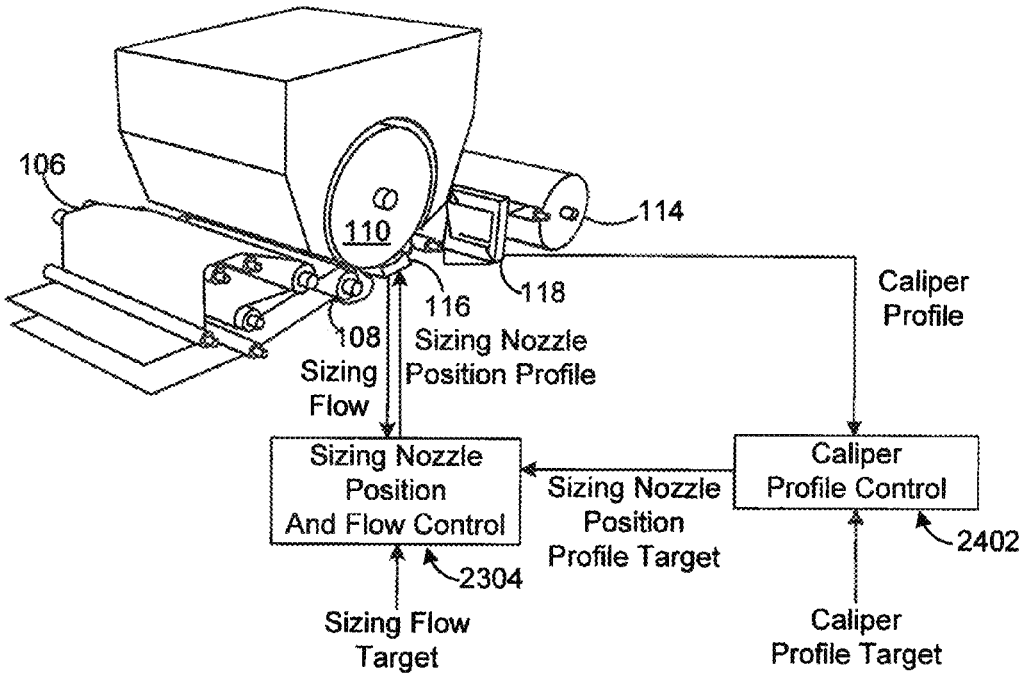

In FIG. 24, a profile of caliper measurements of the web 254 are provided from the scanner 118 to a caliper profile control unit 2402. The profile here represents a collection of caliper measurements across the width of the web 254 in the cross direction, where each measurement is associated with a different portion or zone of the web 254. The control unit 2402 also receives a profile target for the caliper, which could come from any suitable source. The profile target identifies the target caliper value for each portion or zone of the web 254.

The control unit 2402 uses the caliper measurement profile to determine how to adjust a sizing nozzle position profile target, such as by using a model that associates caliper and sizing nozzle positions. The sizing nozzle position and flow control unit 2304 receives the nozzle position profile target, measurements of the flow of sizing agent through the spray boom 116, and the sizing flow target. The control unit 2304 uses this information to adjust the operation of the nozzles in the spray boom 116 in order to achieve the target nozzle position profile. In this way, the caliper measurements ideally converge to or near the caliper target.

Figure 25:
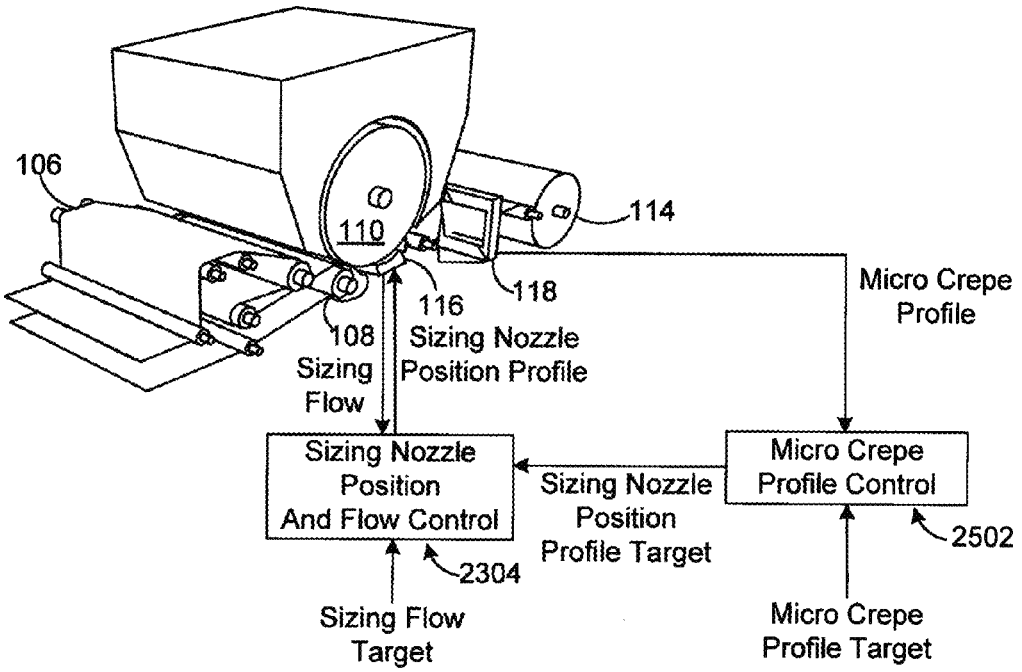

In FIG. 25, a profile of micro crepe measurements of the web 254 are provided from the scanner 118 to a micro crepe profile control unit 2502. The profile here represents a collection of micro crepe measurements across the width of the web 254 in the cross direction, where each measurement is associated with a different portion or zone of the web 254. The control unit 2502 also receives a profile target for the micro crepe, which could come from any suitable source. The profile target identifies the target micro crepe value for each portion or zone of the web 254.

The control unit 2502 uses the micro crepe measurement profile to determine how to adjust a sizing nozzle position profile target, such as by using a model that associates micro crepe and sizing nozzle positions. The sizing nozzle position and flow control unit 2304 receives the nozzle position profile target, measurements of the flow of sizing agent through the spray boom 116, and the sizing flow target. The control unit 2304 uses this information to adjust the operation of the nozzles in the spray boom 116 in order to achieve the target nozzle position profile. In this way, the micro crepe measurements ideally converge to or near the micro crepe target.

Figure 26:
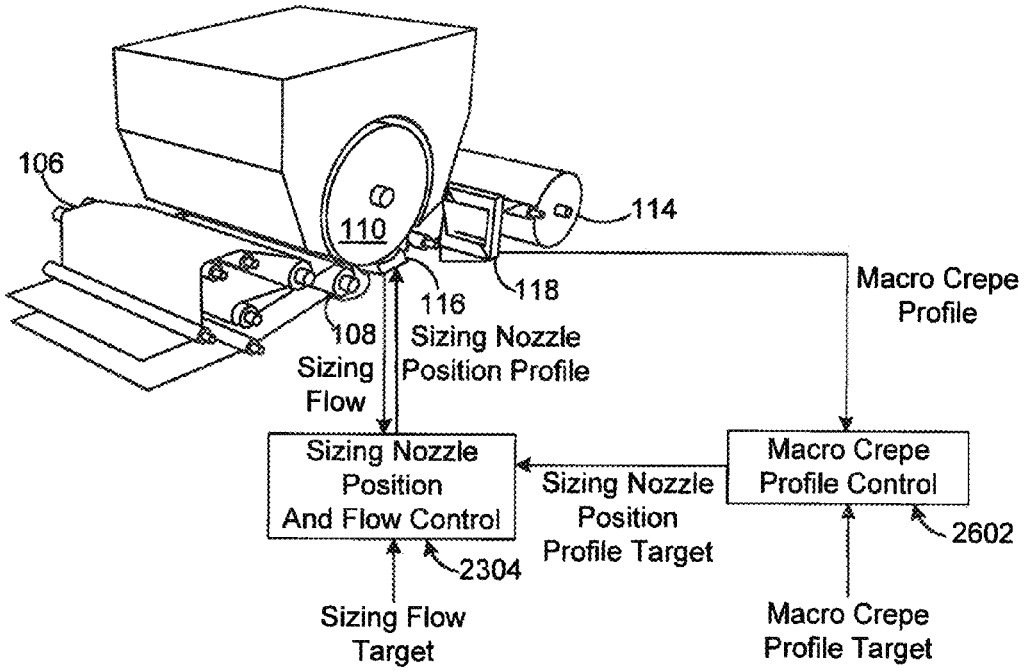

In FIG. 26, a profile of macro crepe measurements of the web 254 are provided from the scanner 118 to a macro crepe profile control unit 2602. The profile here represents a collection of macro crepe measurements across the width of the web 254 in the cross direction, where each measurement is associated with a different portion or zone of the web 254.

The control unit 2602 also receives a profile target for the macro crepe, which could come from any suitable source. The profile target identifies the target macro crepe value for each portion or zone of the web 254.

The control unit 2602 uses the macro crepe measurement profile to determine how to adjust a sizing nozzle position profile target, such as by using a model that associates macro crepe and sizing nozzle positions. The sizing nozzle position and flow control unit 2304 receives the nozzle position profile target, measurements of the flow of sizing agent through the spray boom 116, and the sizing flow target. The control unit 2304 uses this information to adjust the operation of the nozzles in the spray boom 116 in order to achieve the target nozzle position profile. In this way, the macro crepe measurements ideally converge to or near the macro crepe target.

When performing the control actions described above, the controller(s) 130 could be able to adjust various ones of the manipulated variables within limits. For example, crepe percentage, blade angle, and sizing flow rate are grade-dependent parameters, and a new target value (setpoint) for each parameter can be received during a grade change. The controller(s) 130 could implement closed-loop control that allows target values to be adjusted within specified limits, such as plus or minus a certain percentage of an original target value.

Through various changes to these manipulated variables, each of the controlled variables (folds/length, caliper, macro crepe, and/or micro crepe) can be maintained within specified quality limits. This can result in a more consistent quality of the finished creped tissue paper and allow extended blade lifespans.

For CD control of the sizing profile in FIGS. 23 through 26, nozzle actuators can be controlled to reduce or minimize profile variations of the crepe structure parameters (folds/length, caliper, macro crepe, and/or micro crepe). At the same time, the nozzle actuators can be controlled to maintain the average sizing flow at or substantially near the sizing flow setpoint used in MD control.

Note that the control units shown in FIGS. 11 through 26 could be implemented in any suitable manner. For example, in some embodiments, the control units shown in FIGS. 11 through 26 could be implemented using separate controllers 130. In other embodiments, at least some of the control units shown in FIGS. 11 through 26 could be implemented within a single controller 130. As a particular example, different control units associated with the same controlled variable and different manipulated variables could be implemented within a common controller 130. As another particular example, all control units could be implemented within a common controller 130.

Although FIGS. 11 through 26 illustrate examples of closed-loop control techniques for creped tissue paper structure, various changes may be made to FIGS. 11 through 26. For example, while FIGS. 11 through 26 show separate control loops, any combination of these control loops could be used to control one or more characteristics of a web 254.

In some embodiments, various functions described above (such as functions for adjusting a manufacturing process based on creped tissue paper structure and functions for analyzing digital images and identifying creped tissue paper structure) are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

It may be advantageous to set forth definitions of certain words and phrases used throughout this patent document. The terms "application" and "program" refer to one or more computer programs, software components, sets of instructions, procedures, functions, objects, classes, instances, related data, or a portion thereof adapted for implementation in a suitable computer code (including source code, object code, or executable code). The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method comprising:

using at least one processing device:

obtaining measurements associated with one or more controlled variables related to a structure of creped tissue paper during production of the creped tissue paper; and generating at least one control signal that adjusts one or more manipulated variables associated with the production of the creped tissue paper in order to alter the structure of the creped tissue paper;

wherein the one or more controlled variables include a caliper of the creped tissue paper;

wherein the caliper of the creped tissue paper is calculated using a function:

$$C=C_0+C_{CS}$$

where C represents the caliper of the creped tissue paper, $C_0$ represents a base caliper for a given grade of tissue paper, and $C_{CS}$ represents a crepe structure-dependent component of the caliper C; and wherein the crepe structure-dependent component $C_{CS}$ of the caliper is calculated based on a dominant frequency ω of the creped tissue paper and a standard deviation $\sigma_r$ of an intensity of diffusely-reflected light from the creped tissue paper.

2. The method of claim 1, wherein:

the one or more controlled variables further include a number of folds per unit length of the creped tissue paper; and the one or more manipulated variables include at least one of: a crepe percentage, a creping blade angle, and a flow of sizing agent.

3. The method of claim 2, wherein:

the crepe percentage is based on a rotational speed of a Yankee dryer and a rotational speed of a reel or drum that collects the creped tissue paper; and the at least one control signal adjusts the rotational speed of the reel or drum.

4. The method of claim 1, wherein the one or more manipulated variables include at least one of: a crepe percentage, a creping blade angle, and a flow of sizing agent.

5. The method of claim 1, wherein:

the one or more controlled variables further include a macro crepe of the creped tissue paper; and the one or more manipulated variables include at least one of: a crepe percentage, a creping blade angle, and a flow of sizing agent.

6. The method of claim 1, wherein:

the one or more controlled variables further include a micro crepe of the creped tissue paper; and the one or more manipulated variables include at least one of: a crepe percentage, a creping blade angle, and a flow of sizing agent.

7. The method of claim 1, wherein:

the one or more manipulated variables include a cross direction (CD) profile of nozzle positions associated with a spray boom that sprays sizing agent onto a Yankee dryer; and the one or more controlled variables include at least one of: a CD profile of the number of folds per unit length of the creped tissue paper, a CD profile of the caliper of the creped tissue paper, a CD profile of the macro crepe of the creped tissue paper, and a CD profile of the micro crepe of the creped tissue paper.

8. The method of claim 1, wherein generating the at least one control signal comprises generating multiple control signals using multiple models, each model associating one controlled variable and one manipulated variable.

9. An apparatus comprising:

at least one processing device configured to:

obtain measurements associated with one or more controlled variables related to a structure of creped tissue paper;

determine how to adjust one or more manipulated variables associated with production of the creped tissue paper in order to alter the structure of the creped tissue paper; and generate at least one control signal for adjusting the one or more manipulated variables;

wherein the one or more controlled variables include a caliper of the creped tissue paper;

wherein the caliper of the creped tissue paper is calculated using a function:

$$C=C_0+C_{CS}$$

where C represents the caliper of the creped tissue paper, $C_0$ represents a base caliper for a given grade of tissue paper, and $C_{CS}$ represents a crepe structure-dependent component of the caliper C; and wherein the crepe structure-dependent component $C_{CS}$ of the caliper is calculated based on a dominant frequency ω of the creped tissue paper and a standard deviation $\sigma_r$ of an intensity of diffusely-reflected light from the creped tissue paper.

10. The apparatus of claim 9, further comprising:

at least one interface configured to receive the measurements and output the at least one control signal.

11. The apparatus of claim 9, wherein:

the one or more controlled variables further include a number of folds per unit length of the creped tissue paper; and the one or more manipulated variables include at least one of: a crepe percentage a creping blade angle, and a flow of sizing agent.

12. The apparatus of claim 9, wherein the one or more manipulated variables include at least one of: a crepe percentage, a creping blade angle, and a flow of sizing agent.

13. The apparatus of claim 9, wherein:

the one or more controlled variables further include a macro crepe of the creped tissue paper; and the one or more manipulated variables include at least one of: a crepe percentage, a creping blade angle, and a flow of sizing agent.

14. The apparatus of claim 9, wherein:

the one or more controlled variables further include a micro crepe of the creped tissue paper; and the one or more manipulated variables include at least one of: a crepe percentage, a creping blade angle, and a flow of sizing agent.

15. The apparatus of claim 9, wherein:

the one or more manipulated variables include a cross direction (CD) profile of nozzle positions associated with a spray boom that sprays sizing agent onto a Yankee dryer; and the one or more controlled variables include at least one of: a CD profile of the number of folds per unit length of the creped tissue paper, a CD profile of the caliper of the creped tissue paper, a CD profile of the macro crepe of the creped tissue paper, and a CD profile of the micro crepe of the creped tissue paper.

16. The apparatus of claim 9, further comprising:

at least one memory configured to store multiple models, each model associating one controlled variable and one manipulated variable.

17. A non-transitory computer readable medium embodying a computer program, the computer program comprising computer readable program code for:

obtaining measurements associated with one or more controlled variables related to a structure of creped tissue paper; and generating at least one control signal for adjusting one or more manipulated variables associated with production of the creped tissue paper in order to alter the structure of the creped tissue paper;

wherein the one or more controlled variables include a caliper of the creped tissue paper;

wherein the caliper of the creped tissue paper is calculated using a function:

$$C=C_0+C_{CS}$$

where C represents the caliper of the creped tissue paper, $C_0$ represents a base caliper for a given grade of tissue paper, and $C_{CS}$ represents a crepe structure-dependent component of the caliper C; and wherein the crepe structure-dependent component $C_{CS}$ of the caliper is calculated based on a dominant frequency ω of the creped tissue paper and a standard deviation $\sigma_r$ of an intensity of diffusely-reflected light from the creped tissue paper.

18. The computer readable medium of claim 17, wherein the computer readable program code for generating the at least one control signal comprises computer readable program code for generating multiple control signals using multiple models, each model associating one controlled variable and one manipulated variable.

19. The computer readable medium of claim 17, wherein the one or more manipulated variables further include at least one of: a crepe percentage, a creping blade angle, and a flow of sizing agent.

20. The computer readable medium of claim 17, wherein:

the one or more manipulated variables include a cross direction (CD) profile of nozzle positions associated with a spray boom that sprays sizing agent onto a Yankee dryer; and the one or more controlled variables include at least one of: a CD profile of the number of folds per unit length of the creped tissue paper, the CD profile of a caliper of the creped tissue paper, the CD profile of a macro crepe of the creped tissue paper, and the CD profile of a micro crepe of the creped tissue paper.

21. The method of claim 1, wherein:

the dominant frequency ω is associated with a number of folds per unit length of the creped tissue paper;

the standard deviation $\sigma_r$ is associated with a macro crepe of the creped tissue paper; and the crepe structure-dependent component $C_{CS}$ of the caliper is expressed as:

$$k\frac{\sqrt{\text{Macro Crepe}}}{\text{Folds per unit length}}$$

where k is a grade-dependent constant.

* * * * *